US005974996A

United States Patent [19]

Nozaki et al.

[11] Patent Number: 5,974,996

[45] Date of Patent: Nov. 2, 1999

[54] ELECTRONICALLY CONTROLLED SEWING SYSTEM

[75] Inventors: Yoshihisa Nozaki, Aichi-ken; Koichi Akahane, Nagoya; Motonari Nakano, Ichinomiya; Akira Nishio, Aichi-ken; Takashi Kondo, Oobu; Tomoyuki Fujita, Tajimi; Minoru Yamaguchi, Kariya; Koichi Harada, Komaki, all of Japan

[73] Assignee: Brother Kogyo Kabushiki Kaisha, Nagoya, Japan

[21] Appl. No.: 09/178,574

[22] Filed: Oct. 26, 1998

[30] Foreign Application Priority Data

Apr. 8, 1996 [JP] Japan ..... 8-111982
Nov. 7, 1997 [JP] Japan ..... 9-322330

[51] Int. Cl.[6] ..... D05B 3/12; D05B 21/00

[52] U.S. Cl. ..... 112/470.04; 112/470.06; 112/470.34

[58] Field of Search ..... 112/470.04, 470.06, 112/470.34, 475.13, 102.5, 104, 456, 458

[56] References Cited

U.S. PATENT DOCUMENTS 5,417,174 5/1995 Allison et al. ..... 112/104 X
5,752,456 5/1998 Nishizawa et al. ..... 112/470.06 X
5,775,240 7/1998 Hara et al. ..... 112/102.5

FOREIGN PATENT DOCUMENTS

U-6-81481 11/1994 Japan .

*Primary Examiner*—Peter Nerbun
*Attorney, Agent, or Firm*—Oliff & Berridge, PLC

[57] ABSTRACT

A sewing system including a stitch-forming device including at least one sewing needle, for forming stitches on at least one workpiece; a feeding device which feeds at least one of the stitch-forming device and the workpiece relative to the other of the stitch-forming device and the workpiece along a reference plane; a control device which controls, according to at least one set of sewing data corresponding to at least one sewing pattern including a plurality of stitches, the stitch-forming device and the feeding device to form the stitches of the sewing pattern on the workpiece; a dimension-data memory which stores a plurality of sets of dimension data which correspond to a plurality of dimensions, respectively, each of which relates to the set of sewing data; and a selecting device which is operable for selecting one of the sets of dimension data stored in the dimension-data memory.

24 Claims, 19 Drawing Sheets

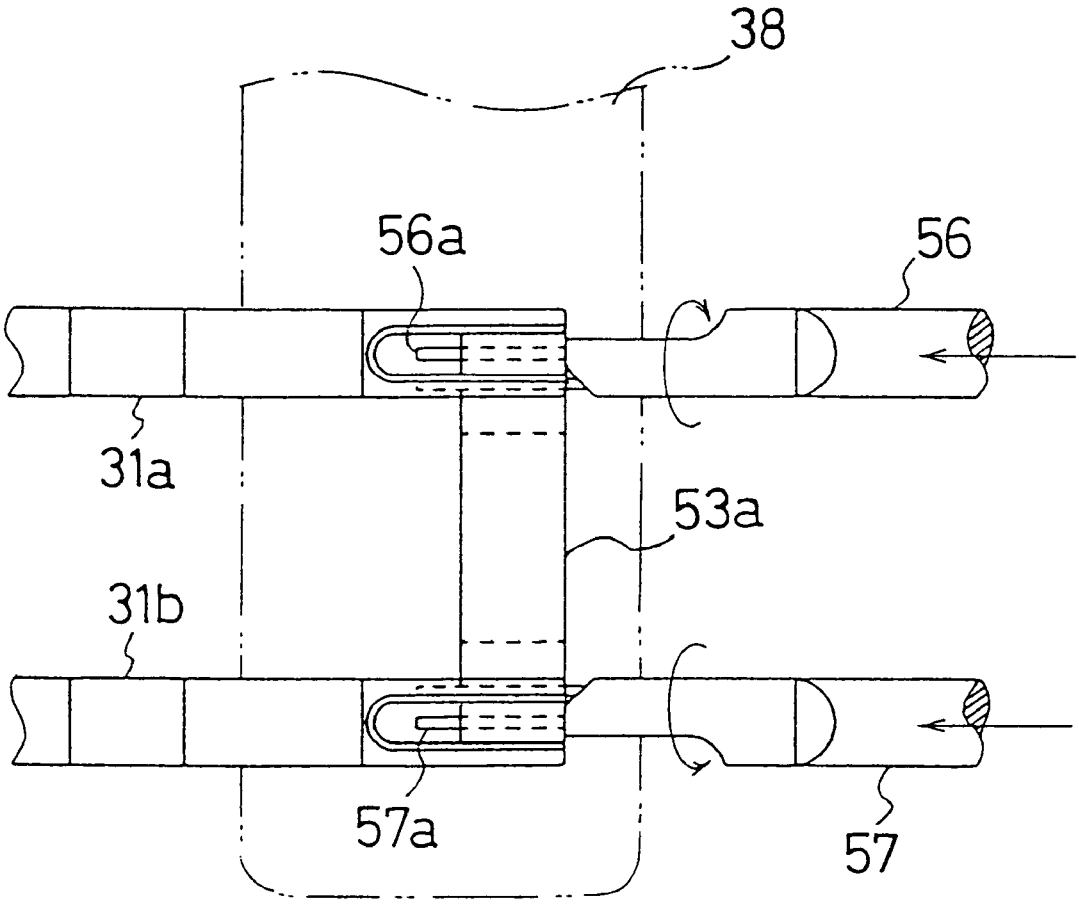
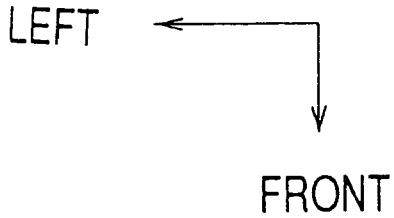
FIG. 4

FIG. 6

63a

| |
|---|
| INDEX NUMBER "10" |
| X-DIRECTION MAGNIFICATION "80" |
| Y-DIRECTION MAGNIFICATION "110" |
| INDEX NUMBER "11" |
| X-DIRECTION MAGNIFICATION "85" |
| Y-DIRECTION MAGNIFICATION "85" |
| INDEX NUMBER "12" |
| X-DIRECTION MAGNIFICATION "75" |
| Y-DIRECTION MAGNIFICATION "80" |
| INDEX NUMBER "13" |
| X-DIRECTION MAGNIFICATION "110" |
| Y-DIRECTION MAGNIFICATION "100" |
| INDEX NUMBER "14" |
| X-DIRECTION MAGNIFICATION "120" |
| Y-DIRECTION MAGNIFICATION "110" |

FIG. 7A
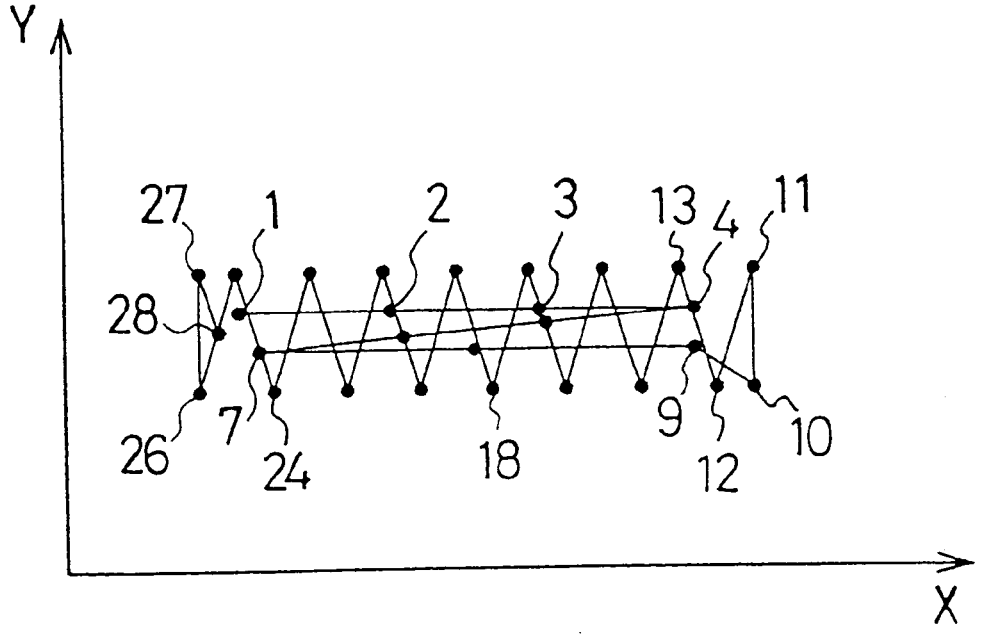
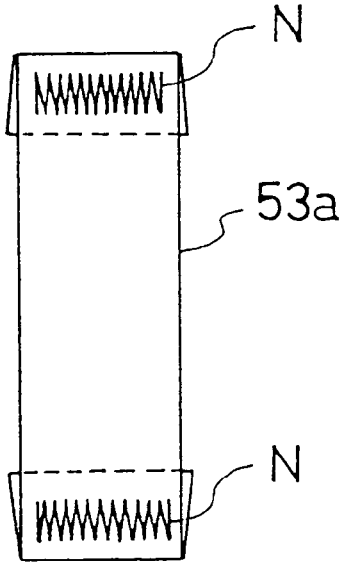
FIG. 7B

ELECTRONICALLY CONTROLLED SEWING SYSTEM

BACKGROUND OF THE INVENTION

1. Field of the Invention

The present invention generally relates to a sewing system which forms a sewing pattern on a workpiece such as a pair of trousers or a skirt and particularly to such a sewing system which can modify a set of sewing data corresponding to a sewing pattern and form a sewing pattern according to the modified set of sewing data.

2. Related Art Statement

There is known an electronically controlled sewing system including a two-needle sewing machine which has a pair of sewing needles and a pair of thread-loop catchers and which simultaneously forms respective identical bar-tacking patterns on opposite end portions of a belt loop so as to attach the belt loop to a base material such as a pair of trousers or a skirt. A belt is passed through the belt loops attached to the trousers or the skirt. For example, Japanese Utility Model Application laid open for inspection purposes under Publication No. 6(1994)-81481 discloses a two-needle rotary-hook-type sewing machine and a two-needle shuttle-type sewing machine each of which includes a needle bar having a needle support at its lower end; two needles supported by the needle support; a sewing bed; two thread-loop catchers (rotary hooks, or shuttles) which are provided in the sewing bed and which correspond to the two sewing needles, respectively; a main shaft which is connected to the needle bar and which is driven or rotated by a main motor; and a lower shaft which is connected to the loop catchers and to which the rotation of the main shaft is transmitted to drive or rotate the loop catchers.

Each of the above-indicated two-needle sewing machines further includes a workpiece feeding device having a workpiece-feed plate and a plate cam which is connected to the lower shaft and which drives the workpiece-feed plate. The plate cam has a complicated shape which mechanically drives the workpiece-feed plate such that the workpiece supported by the workpiece-feed plate is fed along an X axis and is fed along a Y axis perpendicular to the X axis, independent of the feeding thereof along the X axis. The plate cam mechanically defines the dimensions of a bar-tacking pattern, such as width and length, and the stitch pitch and stitch number of the same. Hence, a reasonable number of plate cams which correspond to different sorts (or sizes) of belt loops, respectively, are prepared in advance. When a current sort of belt loops are changed to a new sort of belt loops, the most appropriate one of the plate cams is newly selected and used to form, on each of the new belt loops, the corresponding bar-tacking pattern which has the most appropriate dimensions, stitch pitch, and stitch number for the each belt loop. However, both the operability of the sewing machines, and the efficiency of sewing of the belt loops are low.

SUMMARY OF THE INVENTION

It is therefore an object of the present invention to provide a sewing system which easily changes a dimension of a sewing pattern to be formed on a workpiece and enjoys a high operability and a high efficiency of forming of sewing patterns.

The present invention provides a sewing system which has one or more of the technical features which are described below in respective paragraphs given parenthesized sequential numbers (1) to (24). Any technical feature which includes another technical feature shall do so by referring, at the beginning, to the parenthesized number given to that technical feature. Thus, two or more of the following technical features may be combined, if appropriate. Each technical feature may be accompanied by a supplemental explanation, as needed.

(1) According to a first feature of the present invention, there is provided a sewing system comprising a stitch-forming device including at least one sewing needle, for forming stitches on at least one workpiece; a feeding device which feeds at least one of the stitch-forming device and the workpiece relative to the other of the stitch-forming device and the workpiece along a reference plane; a control device which controls, according to at least one set of sewing data corresponding to at least one sewing pattern including a plurality of stitches, the stitch-forming device and the feeding device to form the stitches of the sewing pattern on the workpiece; a dimension-data memory which stores a plurality of sets of dimension data which correspond to a plurality of dimensions, respectively, each of which relates to the set of sewing data; and a selecting device which is operable for selecting one of the sets of dimension data stored in the dimension-data memory. The feeding device may rotate the workpiece (e.g., a cap, a hat, or a sleeve) about a horizontal axis. In this case, the workpiece is fed substantially along a horizontal plane as the reference plane. Each set of dimension data may directly represent at least one dimension (a width and/or length) of a sewing pattern which is to be formed according to the set of sewing data. Otherwise, each set of dimension data may comprise a set of magnification data which represents a magnification, i.e., a degree of enlargement or reduction. In the second case, the set of sewing data represents the sewing pattern having a predetermined dimension, and the predetermined dimension is magnified according to the set of magnification data. A plurality of sets of dimension data may be stored in the dimension-data memory when the present sewing system is produced in a factory, or through operation of a dimension-data input device such as a keyboard. The selecting device may comprise a display and a keyboard which is operable by a user for selecting one of the sets of dimension data on the display. One of the sets of dimension data is easily selected, so that a sewing pattern having the dimension corresponding to the selected set sewing data is formed. Thus, the present invention enjoys an improved operability and an improved efficiency of forming of sewing patterns.

(2) According to a second feature of the present invention which includes the first feature (1), the feeding device comprises a workpiece feeding device which feeds the at least one workpiece comprising a belt loop having predetermined dimensions, and a base material, relative to the stitch-forming device so that the belt loop is sewn to the base material with the stitches of the sewing pattern formed by the stitch-forming device. The base material may be a pair of trousers, or a skirt, and one or more belt loops are sewn to the base material with the stitches of a sewing pattern such as a bar-tacking pattern. The set of sewing data may represent a sewing pattern having predetermined width and length.

(3) According to a third feature of the present invention which includes the second feature (2), the stitch-forming device comprises two sewing needles for simultaneously forming respective identical sewing patterns on opposite end portions of the belt loop. Alternatively, the stitch-forming device may comprise a single sewing needle for forming a sewing pattern on one of opposite end portions of the belt loop and subsequently forming an identical sewing pattern on the other end portion of the same.

(4) According to a fourth feature of the present invention which includes the second or third feature (2) or (3), the sewing system further comprises a belt-loop supplying device which supplies the belt loop to the workpiece feeding device.

(5) According to a fifth feature of the present invention which includes any one of the first to fourth features (1) to (4), the control device comprises modifying means for modifying the set of sewing data based on the set of dimension data selected through the selecting device; and control means for controlling, according to the modified set of sewing data, the stitch-forming device and the feeding device to form, on the workpiece, a sewing pattern having the dimension corresponding to the selected set of dimension data.

(6) According to a sixth feature of the present invention which includes the fifth feature (5), the set of sewing data comprises a plurality of sets of stitch-position data each set of which represents a stitch position where the sewing needle penetrates the workpiece to form a corresponding one of the stitches of the sewing pattern, the modifying means comprises means for modifying the sets of stitch-position data based on the selected set of dimension data, and the control means controls, according to the modified sets of stitch-position data, the stitch-forming device and the feeding device to form the stitches of the sewing pattern having the dimension corresponding to the selected set of dimension data.

(7) According to a seventh feature of the present invention which includes any one of the first to sixth features (1) to (6), the sewing system further comprises a sewing-data memory which stores the at least one set of sewing data. In the case where the sewing-data memory stores a plurality of sets of sewing data corresponding to a plurality of sewing patterns, respectively, a user can select an appropriate one of the sets of dimension data for each of the sewing patterns.

(8) According to an eighth feature of the present invention which includes any one of the first to seventh features (1) to (7), the sewing system further comprises an input device which is operable for inputting each of the sets of dimension data so that the dimension-data memory stores the each set of dimension data.

(9) According to a ninth feature of the present invention which includes any one of the first to eighth features (1) to (8), the reference plane comprises an X-Y coordinate plane defined by an X axis and a Y axis perpendicular to the X axis, and the dimension-data memory comprises means for storing the sets of dimension data each set of which corresponds to a first dimension along the X axis and a second dimension along the Y axis. In this case, each set of dimension data may directly represent a width and a length of a sewing pattern to be formed, or may comprise a set of magnification data which may represent a first magnification (enlargement or reduction) with respect to the X axis and a second magnification with respect to the Y axis. The first and second magnifications may be equal to, or different from, each other. However, the set of magnification data may represent a single magnification, so that the stitch-forming device may form a similar sewing pattern according to the modified set of sewing data.

(10) According to a tenth feature of the present invention which includes the ninth feature (9), the sewing system comprises an input device which is operable for inputting the each set of dimension data so that the dimension-data memory stores the each set of dimension data.

(11) According to an eleventh feature of the present invention which includes the ninth or tenth feature (9) or (10), the stitch-forming device comprises a first drive device for reciprocating the sewing needle, and the feeding device comprises a second drive device for feeding the at least one of the stitch-forming device and the workpiece substantially along the X axis and a third drive device for feeding the at least one of the stitch-forming device and the workpiece substantially along the Y axis, substantially independent of the movement of the at least one of the stitch-forming device and the workpiece along the X axis.

(12) According to a twelfth feature of the present invention which includes any one of the first to eleventh features (1) to (12), the selecting device comprises a display device which displays at least one of the sets of dimension data stored in the dimension-data memory and a plurality of sets of identification data each set of which identifies a corresponding one of the sets of dimension data; and a designator which is operable for designating, on the display device, at least one of one of the sets of dimension data and one of the sets of identification data. The designator may be a mouse and a cursor which is movable on the display under control of the mouse.

(13) According to a thirteenth feature of the present invention which includes the twelfth feature (12), the dimension-data memory comprises memory means for storing the sets of dimension data and the sets of identification data.

(14) According to a fourteenth feature of the present invention which includes the thirteenth feature (13), the memory means comprises means for storing the sets of identification data each set of which represents an index number identifying a corresponding one of the sets of dimension data. The index numbers may be sequential numbers.

(15) According to a fifteenth feature of the present invention which includes the thirteenth feature (13), the memory means comprises means for storing the sets of identification data each set of which identifies a company and a specification specifying a corresponding one of the sets of dimension data.

(16) According to a sixteenth feature of the present invention which includes any one of the first to fifteenth features (1) to (15), the dimension-data memory comprises memory means for storing the sets of dimension data comprising a plurality of sets of magnification data which represents a plurality of magnifications, respectively, each of which relates to the set of sewing data. Each magnification may be a degree of enlargement (e.g., 120%) or a degree of reduction (e.g., 80%). In the case where the set of sewing data represents the sewing pattern having at least one prescribed dimension (e.g., prescribed width and length), each set of magnification data represents at least one dimension of a sewing pattern to be formed.

(17) According to a seventeenth feature of the present invention which includes the sixteenth feature (16), the reference plane comprises an X-Y coordinate plane defined by an X axis and a Y axis perpendicular to the X axis, and the memory means comprises means for storing the sets of magnification data each set of which represents a first magnification with respect to the X axis, and a second magnification with respect to the Y axis. The first and second magnifications may be equal to, or different from, each other.

(18) According to an eighteenth feature of the invention which includes any one of the first to seventeenth features (1) to (17), the dimension-data memory comprises a non-volatile memory. The non-volatile memory may be a programmable non-volatile memory, such as a floppy disk or a flash memory, or a RAM chip or card which is backed up by a battery.

(19) According to a nineteenth feature of the invention, there is provided a sewing system comprising a stitch-forming device including at least one sewing needle, for forming respective identical sewing patterns each of which includes a plurality of stitches, on opposite end portions of a belt loop having predetermined dimensions; a feeding device which feeds the belt loop and a base material relative to the stitch-forming device along a reference plane; a sewing-data memory which stores a set of sewing data corresponding to the identical sewing patterns; a control device which controls, according to the set of sewing data, the stitch-forming device and the feeding device to form the stitches of the identical sewing patterns on the belt loop; an input device which is operable for inputting a set of dimension data which corresponds to at least one dimension relating to the set of sewing data; and the control device comprising modifying means for modifying, based on the input set of dimension data, the set of sewing data stored in the sewing-data memory, so that the control device controls, according to the modified set of sewing data, the stitch-forming device and the feeding device to form, on the belt loop, two identical sewing patterns each of which has the at least one dimension corresponding to the set of dimension data. The present sewing system does not require a user to change a current plate cam to a new plate plate cam, when a current sort of workpieces are changed to a new sort of workpieces. The user only needs to input a set of dimension data which corresponds to at least one dimension of the new sort of workpieces. Thus, the present sewing system enjoys the same advantages as those of the sewing system in accordance with the above-described first feature (1).

(20) According to a twentieth feature of the present invention which includes the nineteenth feature (19), the stitch-forming device comprises two sewing needles for simultaneously forming the respective identical sewing patterns on the opposite end portions of the belt loop.

(21) According to a twenty-first feature of the present invention which includes the nineteenth or twentieth feature (19) or (20), the sewing system further comprises a belt-loop supplying device which supplies the belt loop to the feeding device.

(22) According to a twenty-second feature of the present invention which includes any one of the nineteenth to twenty-first features (19) to (21), the reference plane comprises an X-Y coordinate plane defined by an X axis and a Y axis perpendicular to the X axis, and the input device comprises input means for inputting the set of dimension data which corresponds to a first dimension along the X axis and a second dimension along the Y axis.

(23) According to a twenty-third feature of the present invention which includes any one of the nineteenth to twenty-second features (19) to (22), the input device comprises input means for inputting the set of dimension data comprising a set of magnification data which represents a magnification relating to the set of sewing data. In this case, the set of sewing data represents the sewing pattern having at least one predetermined dimension.

(24) According to a twenty-fourth feature of the present invention which includes the twenty-third feature (23), the reference plane comprises an X-Y coordinate plane defined by an X axis and a Y axis perpendicular to the X axis, and wherein the input means comprises means for inputting the set of magnification data which represents a first magnification with respect to the X axis and a second magnification with respect to the Y axis.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 4 is an enlarged plan view of a portion of a belt-loop supplying device of the sewing system of FIG. 1;

FIG. 6 is a view for explaining a plurality of sets of magnification data stored in a magnification-data memory of the sewing system of FIG. 1;

FIG. 7A is a view for explaining a set of sewing data for sewing a bar-tacking pattern;

FIG. 7B is a plan view of a belt loop on which two bar-tacking patterns each having the most appropriate dimensions are sewn by the sewing system of FIG. 1;

DETAILED DESCRIPTION OF THE PREFERRED EMBODIMENTS

Referring next to FIGS. 1 to 14, there will be described an electronically controlled sewing system 1 (FIG. 1) which is capable of simultaneously sewing respective identical bar-tacking patterns on opposite end portions of a belt loop 53*a* (FIG. 4) to attach the belt loop 53*a* to a base material such as a pair of trousers or a skirt (not shown). The sewing system 1 embodies the present invention.

Figure 1:
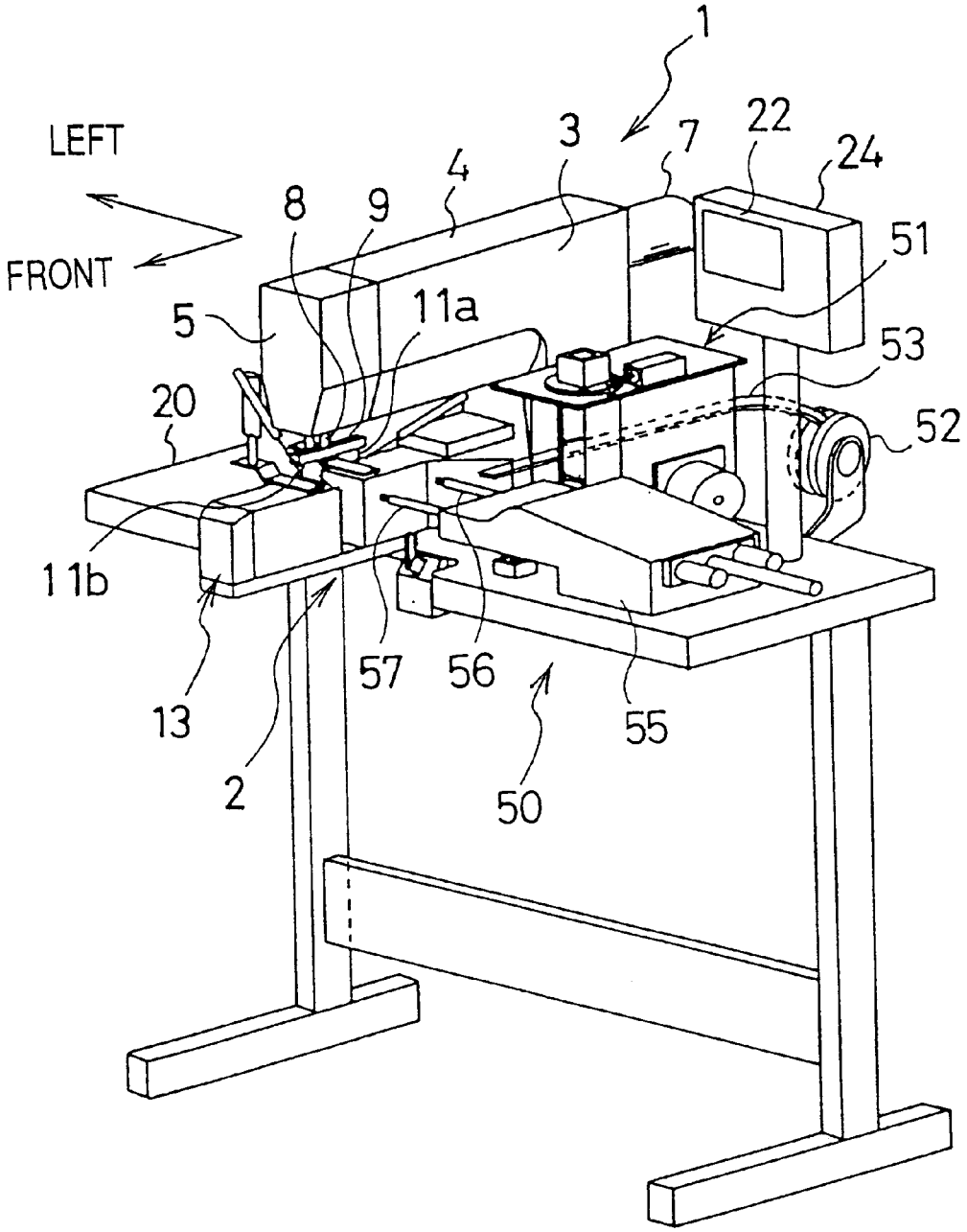
FIG. 1 is a schematic perspective view of a sewing system embodying the present invention.
Figure 2:
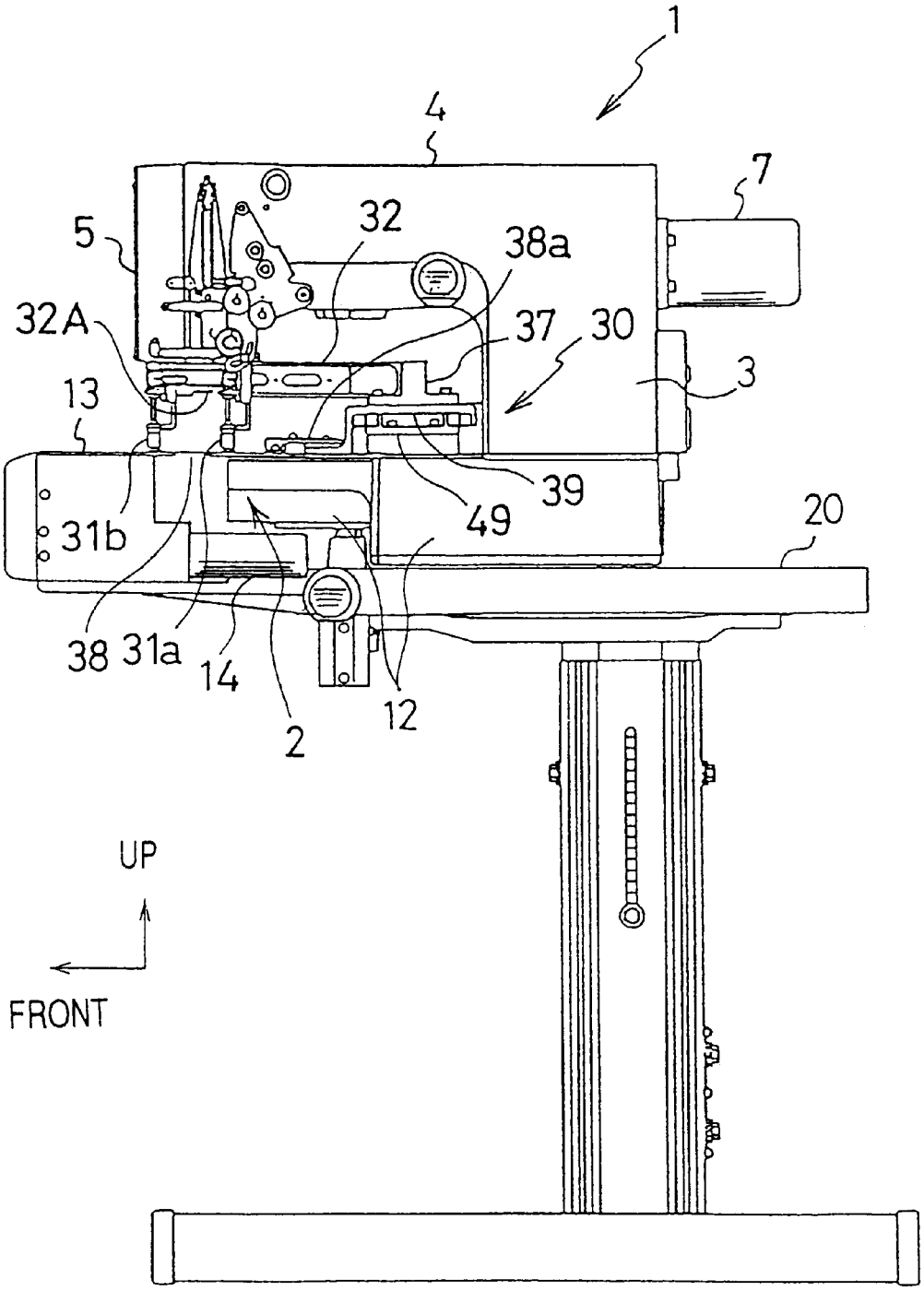
FIG. 2 is a right-hand side elevation of the sewing system of FIG. 1.

As shown in FIGS. 1 and 2, the sewing system 1 includes a two-needle sewing machine 2, 3, 4, 5 which is provided on a generally middle portion of an operation table 20, such that the sewing machine 2, 3, 4, 5 extends in a front-rear direction, i.e., a Y-axis direction (hereinafter, referred as as the "Y direction"). On a right-hand side portion of the table 20, there is provided an operation panel 24 which includes a liquid-crystal display (LCD) 22 and a keyboard 23 (FIG. 11); and a belt-loop supplying device 50 which supplies a continuous belt-loop material 53 and cuts the belt-loop material 53 into a number of belt loops 53*a*.

The sewing machine 2, 3, 4, 5 includes a bed 2, a column 3 which stands on a rear end portion of the bed 2, an arm 4 which extends horizontally frontward from an upper end portion of the column 3, and a sewing head 5 which is supported by a front end portion of the arm 4. A main shaft (not shown) which extends in the arm 4 is driven rotated by a main motor 7 which is provided by an induction motor. A needle bar 8 is reciprocated vertically up and down by the main motor 7 via the main shaft and a needle-bar crank mechanism (not shown). A pair of sewing needles 11*a*, 11*b* are supported by a needle support member 9 fixed to a lower end of the needle bar 8. The position of the front needle 11*b* is adjustable relative to that of the rear needle 11*a* in the front-rear direction.

The bed 2 includes a main portion 12, and a shuttle module 13 which is provided on a front side of the main portion 12, at a predetermined distance from the same 12. A first shuttle (not shown) as a first thread-loop catcher is provided in a front end portion of the main portion 12, and a second shuttle (not shown) as a second thread-loop catcher is provided in a rear end portion of the shuttle module 13. Each of the first and second shuttles accommodates a bobbin around which a bobbin thread is wound. The first shuttle is connected to a lower shaft (not shown) which extends in the main portion 12 and which is reciprocatively rotated by the main motor 7 via the main shaft and an oscillating mechanism (not shown) connected to the main shaft. Thus, the first shuttle is driven in synchronism with the vertical reciprocation of the rear sewing needle 11*a*, like in a common sewing machine.

The shuttle module 13 is provided by a unit which mainly includes the second shuttle and a shuttle drive motor 14 which drives the second shuttle independent of the main shaft. The second shuttle is driven by the shuttle drive motor 14 which is electronically controlled by an electronic control device 60 (FIG. 5) in synchronism with the main shaft. Thus, the second shuttle is synchronized with the vertical reciprocation of the front sewing needle 11*b* so as to be able to sew a bar-tacking pattern.

Figure 3:
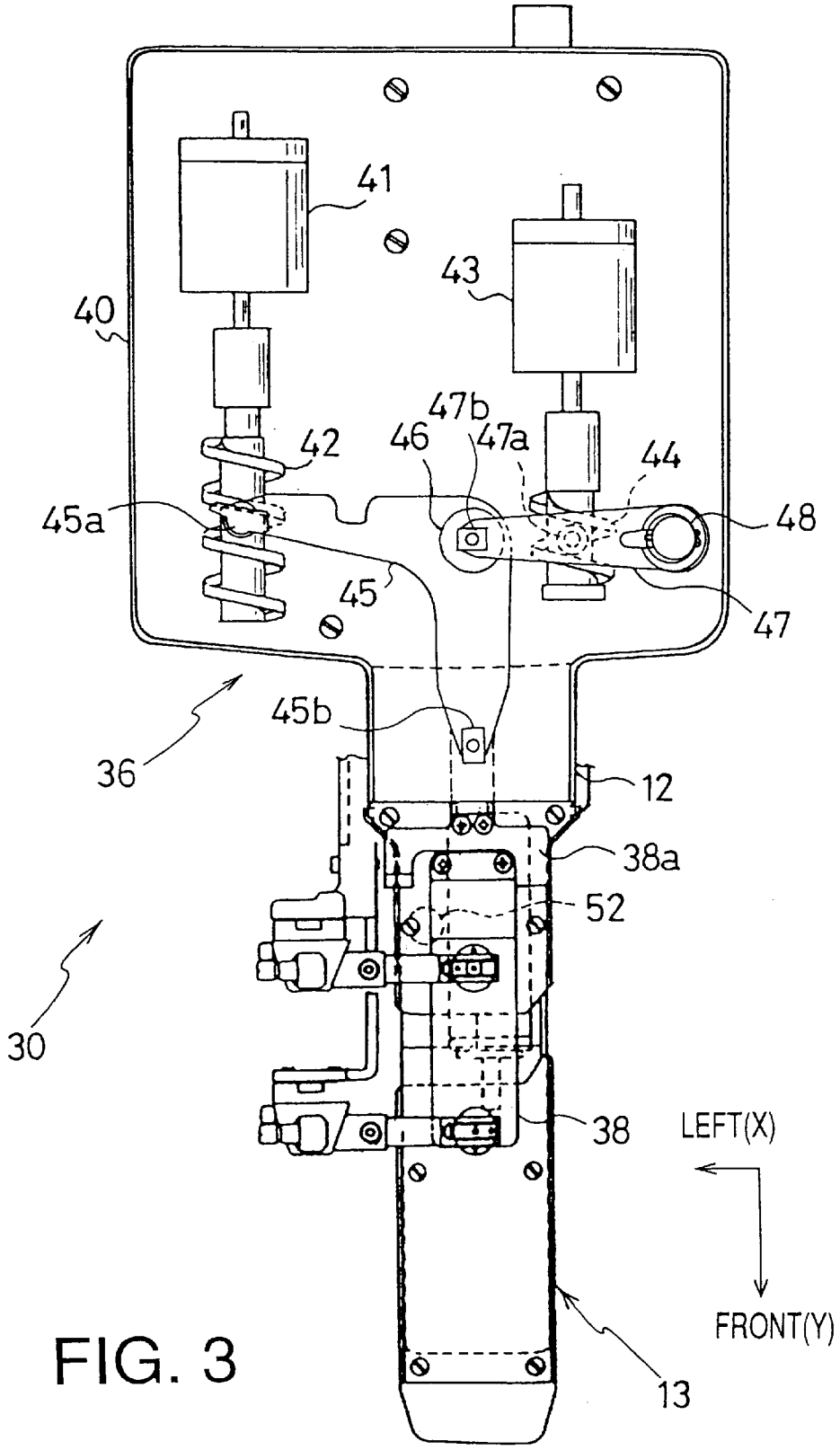
FIG. 3 is a plan view of a workpiece feeding device of the sewing system of FIG. 1.

Next, a workpiece feeding device 30 will be described by reference to FIGS. 2 and 3.

The workpiece feeding device 30 includes two workpiece-press feet 31*a*, 31*b* corresponding to the two sewing needles 11*a*, 11*b*, respectively. The rear press foot 31*a* is supported by a front end of a fixed support-arm member 32, and the front press foot 31*b* is supported by a front end of a movable support-arm member 32A which is supported by the fixed support-arm member 32 such that the movable member 32A is movable or slideable relative to the fixed member 32 in the front-rear direction. The fixed arm 32 is fixed to a connection member 37 of an X-Y feed device 36.

The workpiece feeding device 30 additionally includes a workpiece support plate 38 which extends over the main portion 12 and the shuttle module 13 of the bed 2 and which cooperates with the two press feet 31*a*, 31*b* to hold a workpiece or workpieces, such as a pair of trousers and a piece of belt loop 53*a* supplied thereto, and feed the workpieces in an X-axis direction (i.e., a left-right direction; hereinafter, referred as the "X direction"), and in the Y direction (i.e., the front-rear direction) independent of the feeding of the workpieces in the X direction.

The workpiece support plate 38 is fixed to a first feed member 39 via a connection plate 38*a*, and the first feed member 39 is fixed to the connection member 37. Thus, the workpieces are fed in the state in which the workpieces are held by the cooperation of the workpiece support plate 38 and the workpiece-press feet 31*a*, 31*b*.

Next, the X-Y feed device 36 will be described briefly. The X-Y feed device 36 includes a case 40 which is provided in a rear end portion of the main portion 12 of the bed 2. In the case 40, there is provided a θ-axis drive motor 41 which drives a first spiral cam 42, and an R-axis drive motor 43 which drives a second spiral cam 44. An L-shaped arm member 45 is pivotable, at a middle portion thereof, about a vertical n axis member 46. The pivotable arm member 45 includes a first roller 45*a* which is engaged with a cam groove of the first spiral cam 42; and a front-end member 45*b* which is connected to the first feed member 39.

A bar-like arm member 47 which is pivotable, at a base portion thereof, about a vertical axis member 48, has, at a middle portion thereof, a second roller 47*a* which is engaged with a cam groove of the second spiral cam 44; and a left-end member 47*b* which is connected to a second feed member 49. The second feed member 49 is supported by a first slide unit (not shown) such that the feed member 49 is movable or slideable in the Y direction, and the first feed member 39 is supported by a second slide unit (not shown) such that the first feed member 39 is slideable relative to the second feed member 49 in the X direction. Thus, the R-axis drive motor 43 feeds the second feed member 49 mainly in the Y direction via the spiral cam 44, the pivotable arm 47, and the first slide unit; and the θ-axis drive motor 41 feeds the first feed member 39 mainly in the X direction via the spiral cam 42, the pivotable arm 45, and the second slide unit. However, strictly, the two motors 41, 43 cooperate with each other to feed the workpieces in the X or Y direction. Thus, the control device 60 can accurately control the amount of feeding of the workpieces in each of the positive and negative X directions and the positive and negative Y directions, by controlling the rotation amount and rotation direction of each of the two motors 41, 43.

Next, the belt-loop supplying device 50 provided on the table 20 will be described by reference to FIG. 1. However, since the belt-loop supplying device 50 is known in the art, only a short description thereof will be provided.

The belt-loop supplying device 50 basically includes a loop-material supply device 51 which supplies the continuous belt-loop material 53 and cuts the material 53 into a number of belt loops 53*a* each having a predetermined length, and a belt-loop feed device 55 which feeds each of the belt loops 53*a* onto a pair of trousers placed and supported on the workpiece support plate 38.

The loop-material supply device 51 is provided in the vicinity of the column 3, and includes a loop-material supply reel 52 which is rotatably supported by the table 20 and which supplies the continuous belt-loop material 53. The supply device 51 cuts the continuous material 53 into a number of belt loops 53*a* each having a predetermined length, and supplies each of the belt loops 53*a* to the belt-loop feed device 55. Meanwhile, as shown in FIG. 1, the belt-loop feed device 55 is provided in the vicinity of the head 5 and in front of the loop-material supply device 51. The feed device 55 includes a pair of loop-folding members 56, 57 corresponding to the pair of workpiece-press feet 31*a*, 31*b*, respectively, and can simultaneously move the two loop-folding members 56, 57 in each of the positive and negative X directions.

The loop-holding members 56, 57 include respective free end portions providing respective holding portions 56*a*, 57*a* which hold opposite end portions of each belt loop 53*a*, respectively, supplied from the loop-material supply device 51. In the state in which the two holding portions 56*a*, 57*a* hold the opposite end portions of each belt loop 53*a*, the loop-holding members 56, 57 are rotated by a predetermined angle in opposite directions, respectively, in which the opposite end portions of the belt loop 53*a* are folded back beneath the remaining, intermediate portion of the same 53*a*. Then, the two loop-holding members 56, 57 are simultaneously advanced leftward so that the belt loop 53*a* is fed to a predetermined position on the pair of trousers. Subsequently, the pair of workpiece-press feet 31*a*, 31*b* are simultaneously moved down to hold the workpieces, i.e., the belt loop 53*a* and the pair of trousers. When the two sewing needles 11*a*, 11*b* simultaneously sew respective bar-tacking patterns, the workpiece support plate 38 and the workpiece-press feet 31*a*, 31*b* are fed together with each other in the X and Y directions. Thus, as shown in FIG. 7B, two bar-tacking patterns, N, are simultaneously formed on the opposite end portions of the belt loop 53*a*, respectively, so that the belt loop 53*a* is sewn to the pair of trousers.

Figure 5:
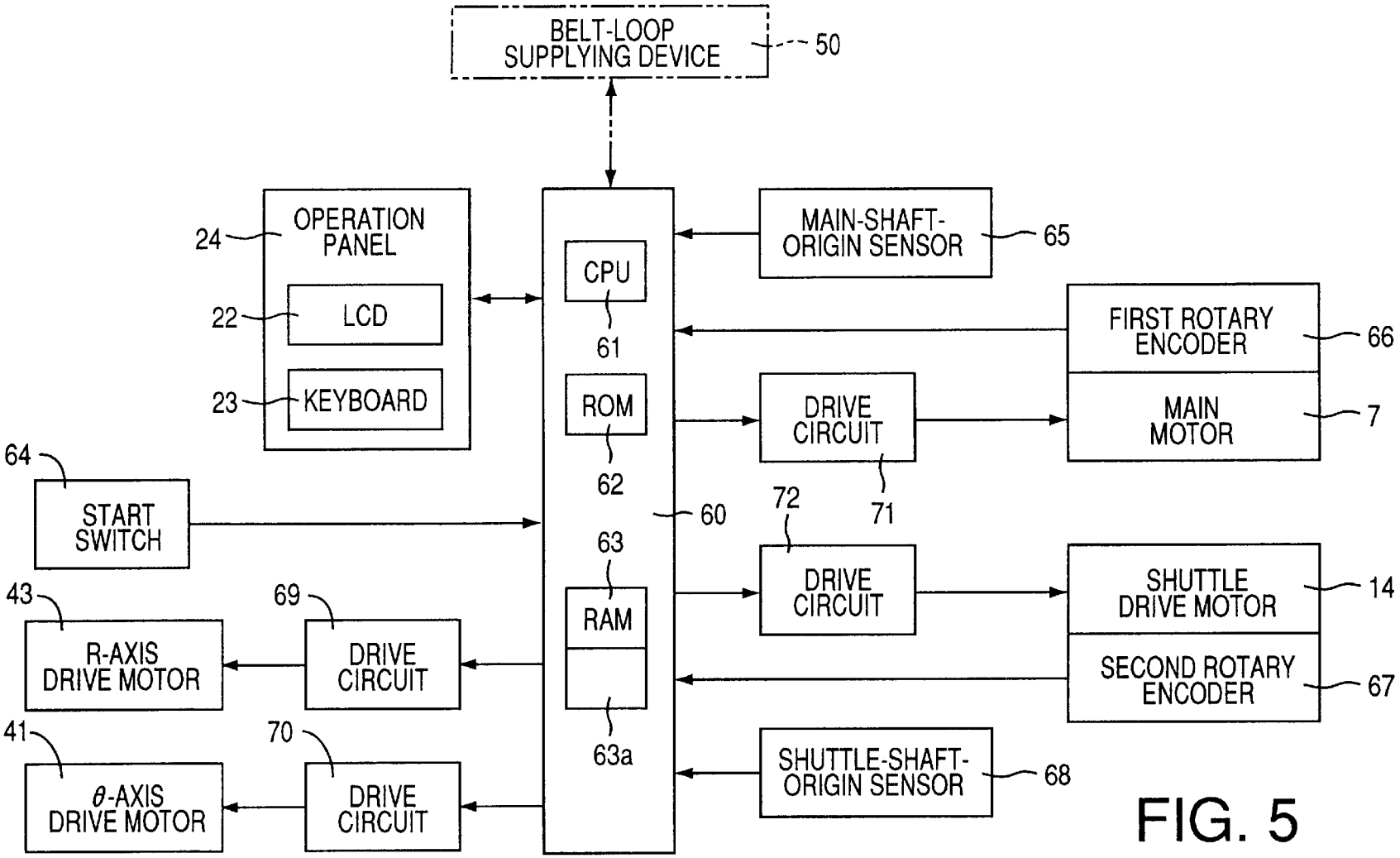
FIG. 5 is a diagrammatic view of an electronic control device of the sewing system of FIG. 1.

Next, the electronic control device 60 of the sewing system 1 will be described by reference to FIG. 5.

The control device 60 includes a microcomputer which is provided by a central processing unit (CPU) 61, a read only memory (ROM) 62, and a random access memory (RAM) 63; bus including data bus; and an input interface (not shown) and an output interface (not shown) which are connected to the microcomputer via the bus. The input interface is supplied with various signals from a start switch 64, the keyboard 23 of the operation panel 24, a main-shaft-origin sensor 65 which detects an origin position of the main shaft, a first rotary encoder 66 associated with the main motor 7, a second rotary encoder 67 associated with the shuttle drive motor 14, and a shuttle-shaft-origin sensor 68 which detects an origin position of the second shuttle.

The output interface supplies drive signals or pulse signals to the LCD 22 of the operation panel 24, a drive circuit 69 associated with the R-axis drive motor 43, a drive circuit 70 associated with the θ-axis drive motor 41, a drive circuit 71 associated with the main motor 7, and a drive circuit 72 associated with the shuttle drive motor 14.

Figure 11:
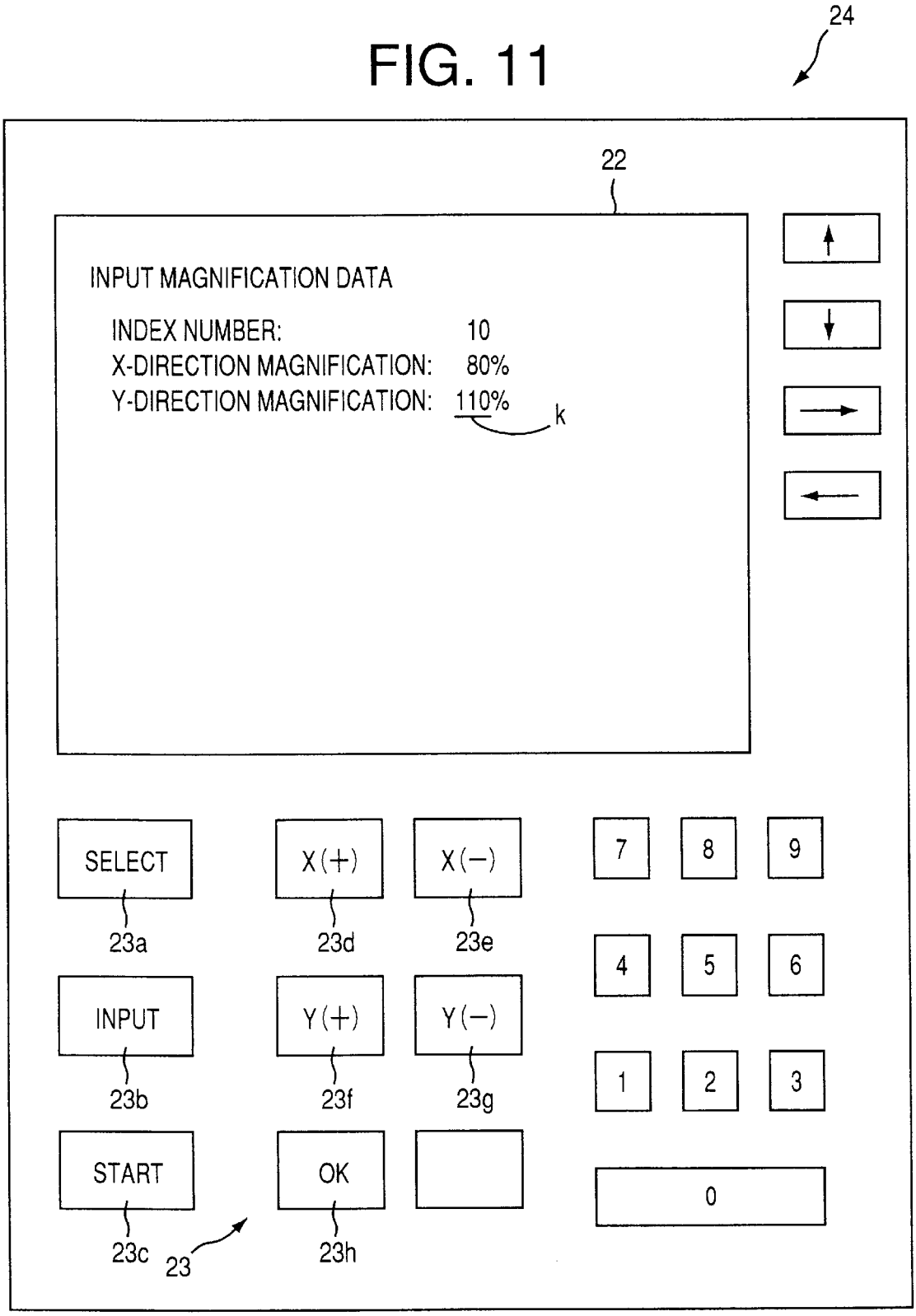
FIG. 11 is a view for explaining a magnification-data input image which is displayed on a display of the sewing system of FIG. 1.

As shown in FIG. 11, the operation panel 24 has the large-size LCD 22, and the keyboard 23 which includes ten numeral keys for inputting ten numerals ("0" to "9"), respectively, and a plurality of function keys such as a magnification-data select key 23*a* which is operated when an operator selects one of magnifications to be used for sewing the bar-tacking pattern N; a magnification-data input key 23*b* which is operated when the operator inputs each of the magnifications; and a sewing-start key 23*c*.

The main-shaft-origin sensor 65 detects an origin position of the main shaft (e.g., the angle of 0 degree corresponding to the upper dead position of the sewing needle 11*a*), and outputs a main-shaft-origin signal indicating that the sensor 65 has detected the origin position of the main shaft. The shuttle-shaft-origin sensor 68 detects an origin position of the second shuttle (e.g., the angle of 0 degree corresponding to the upper dead position of the sewing needle 11*b*), and outputs a shuttle-shaft-origin signal indicating that the sensor 68 has detected the origin position of the second shuttle.

The first rotary encoder 66 outputs clock pulse signals corresponding to the rotation angle of the main motor 7, and the second rotary encoder 67 outputs clock pulse signals corresponding to the rotation angle of the shuttle drive motor 14.

The ROM 62 stores a plurality of sets of sewing data for sewing different sorts of bar-tacking patterns, respectively, such that the sets of sewing data are associated with corresponding pattern numbers. In addition, the ROM 62 stores various control programs for controlling the sewing system 1, including a particular control program for controlling the sewing system 1 to sew a sewing pattern according to the present invention. The particular control program will be described later. As shown in FIG. 6, the RAM 63 includes, in addition to various workpiece memories, buffers, and counters, a magnification-data memory 63*a* which stores a plurality of sets of magnification data each set of which represents an X-direction magnification (percentage, %), a Y-direction magnification (percentage, %), and an index number (e.g., "10", "11", . . . ). As far as the present invention is concerned, the term "magnification" covers not only a degree of enlargement but also a degree of reduction. The sets of magnification data are stored in the memory 63*a* by operating the operation panel 24. At least the memory 63*a* is backed up by a battery, and can keep the sets of magnification data even after the sewing system 1 is cut off from the supply of electric power. Thus, the memory 63*a* functions as an electrically programmable or writable non-volatile memory.

FIG. 7A shows a set of sewing data (i.e., sets of stitch-position data) corresponding to a bar-tacking pattern which can be sewn by the present sewing system 1. This bar-tacking pattern has a 3-mm width, and 28 stitch positions numbered from "1" to "28". The set of sewing data includes 28 combinations of x and y coordinates corresponding to the 28 stitch positions, respectively. Each of the x and y coordinates has an actual dimension (e.g., mm) relative to the origin of the X-Y coordinate system. The present sewing system 1 can sew other sorts of bar-tacking patterns having different widths and lengths, stitch pitches or numbers, and/or stitch lengths.

After, as shown in FIG. 4, the belt-loop feed device 55 supplies the belt loop 53*a* to a predetermined position relative to the workpiece support plate 38, the two sewing needles 11*a*, 11*b* sew respective identical bar-tacking patterns N in respective predetermined sewing areas on the opposite end portions of the belt loop 53*a*, as shown in FIG. 7B.

Meanwhile, in the case where the size of the bar-tacking pattern N is too small or too large relative to the respective sewing areas of the opposite end portions of the belt loop 53*a*, the size of the pattern N should be enlarged or reduced. That is, the set of sewing data corresponding to the bar-tacking pattern N should be modified by the electronic control device 60 according to the set of magnification data selected by the operator from the magnification-data memory 63*a* of the RAM 63.

Next, the operation of the electronic control device 60 for controlling the pattern-sewing operation of the sewing system 1 will be described by reference to the flow charts of FIGS. 8 to 10 in which the symbols "Si" (i=10, 11, . . . ) represent the steps of the control routine.

When electric power is applied to the sewing system 1, the control routine begins. First, at Step S10, the control device 60 carries out initialization in which the main shaft and the second shuttle are rotated to their initial rotation positions. This process must be performed while the sewing needles 11*a*, 11*b* are prevented from colliding with the first and second shuttles, respectively. To this end, first, the control device 60 rotates, based on the main-shaft-origin signal supplied from the main-shaft-origin sensor 65, the main shaft to its initial rotation position substantially corresponding to the upper dead position of the sewing needles 11*a*, 11*b* and, then, the control device 60 operates, based on the shuttle-shaft-origin signal supplied from the shuttle-shaft-origin sensor 68, the shuttle drive motor 14 to rotate the second shuttle to its initial rotation position corresponding to that of the main shaft.

Next, at Step S11, the operator inputs a pattern number corresponding to a desired bar-tacking pattern, by operating the numeral keys on the key board 23 of the operation panel 24. The control device 60 reads, from the ROM 62, the set of sewing data corresponding to the bar-tacking pattern associated with the input pattern number, and stores the set of sewing data in a workpiece memory of the RAM 63. Then, at Step S12, the control device 60 operates the LCD 22 to display an initial screen image containing various data needed to perform the pattern-sewing operation, such as the predetermined length of the belt loops 53*a* supplied from the belt-loop feed device 55 and the number of belt loops 53*a* to be sewn.

Figure 14A:
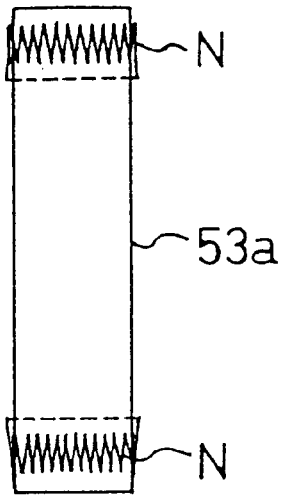
FIG. 14A is a plan view of enlarged identical bar-tacking patterns sewn on a belt loop by the sewing system of FIG. 1.

Meanwhile, FIG. 14A shows the bar-tacking pattern N which is too long relative to a small width of a belt loop 53*a* so that the pattern N overflows the loop 53*a*. On the other hand, the width of the pattern N is somewhat large relative to the belt loop 53*a*. The present sewing system 1 can solve this problem.

At Step S13, the control device 60 judges whether any keys of the keyboard 23 have been operated by the operator. In the case where the operator operates the magnification-data input key 23*b* of the keyboard 23 to input one or more sets of magnification data into the magnification-data memory 63*a*, a positive judgment is made at Step S13 and the control goes to Step S14 in which the control device 60 judges whether the magnification-data select key 23*a* has been operated. In the above case, a negative judgment is made at Step S14 and the control goes to Step S15 in which the control device 60 judges whether the magnification-data input key 23*b* has been operated. In the above case, a positive judgment is made at Step S15 and the control goes to Step S19, i.e., the magnification-data input routine shown in FIG. 9.

First, at Step S25, the control device 60 operates the LCD 22 to display a magnification-data input screen image as shown in FIG. 11. This screen image includes three input items "INDEX NUMBER", "X-DIRECTION MAGNIFICATION", and "Y-DIRECTION MAGNIFICATION", and respective default values, 100%, for the items "X-DIRECTION MAGNIFICATION" and "Y-DIRECTION MAGNIFICATION". The screen image additionally includes a small cursor, k, for inputting a two-digit number for the item "INDEX NUMBER" and changing the default values "100%" into desired magnification values, i.e., desired enlargement or reduction degrees.

Next, at Step S26, the operator inputs a set of magnification data by using the keyboard 23. More specifically described, first, the user moves the cursor k to a value-input area or pad for a desired item, by operating four cursor-moving keys labelled with arrows. A desired two-digit index value (e.g., "10") for the item "INDEX NUMBER" is input by operating the numeral keys. A desired magnification value (e.g. "80%") for the item "X-DIRECTION MAGNIFICATION" or a desired magnification value (e.g. "110%") for the item "Y-DIRECTION MAGNIFICATION" is input by increasing or decreasing the default value "100%" by operating an X-direction increment key 23*d*, an X-direction decrement key 23*e*, a Y-direction increment key 23*f*, and/or a Y-direction decrement key 23*g* of the operation keys 23. Finally, an "OK" key 23*h* is operated by the operator.

Then, at Step S27, the control device 60 prepares a set of magnification data representing the input values for the above three items, and stores it in the magnification-data memory 63*a* as shown in FIG. 6. Likewise, the operator can additionally input one or more sets of magnification data including its or their index numbers "11", "12", . . . . Each set of magnification data thus stored in the memory 63*a* can be used for all the sets of sewing data, stored in the ROM 62, corresponding the sewing patterns having their pattern numbers. Next, the control returns to Step S13 of the main routine of FIG. 8.

Figure 10:
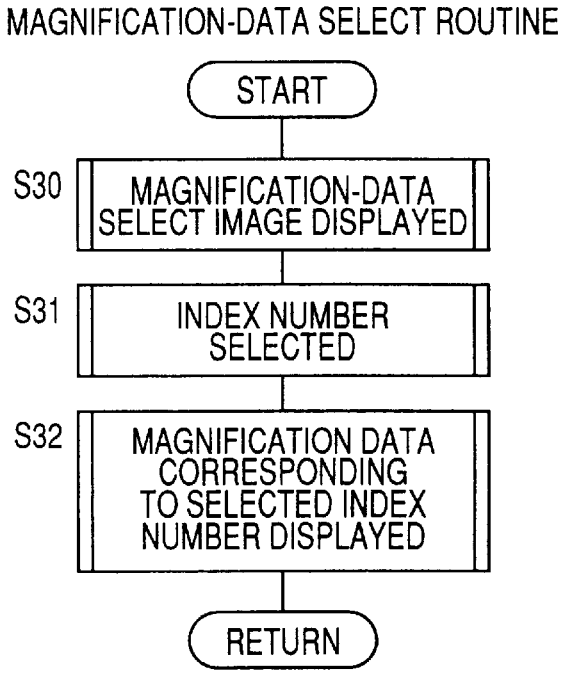
FIG. 10 is a flow chart representing a magnification-data select subroutine as another step of the main routine of FIG. 8.

Meanwhile, in the case where the operator operates the magnification-data select key 23*a*, a positive judgment is made at each of Steps S13 and S14, and the control goes to Step S17, i.e. the magnification-data select routine shown in FIG. 10.

Figure 12:
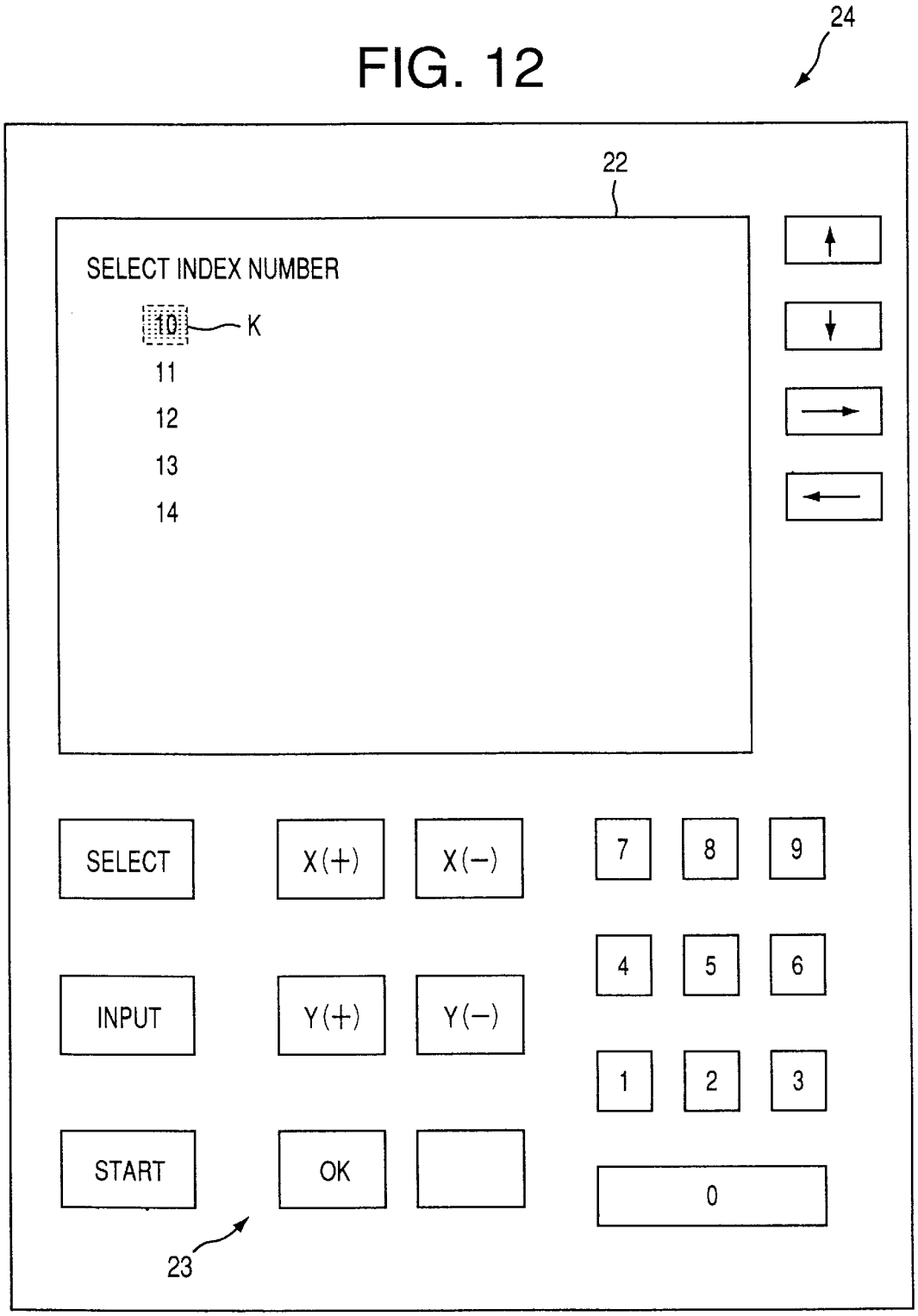
FIG. 12 is a view for explaining a magnification-data select image which is displayed on the display.

First, at Step S30, the control device 60 operates the LCD 22 to display a magnification-data select screen image as shown in FIG. 12. This screen image includes the respective index numbers (e.g., "10" to "14") of all the sets of magnification data stored in the magnification-data memory 63*a*, and a large cursor, K, designating the first or leading index number.

Figure 13:
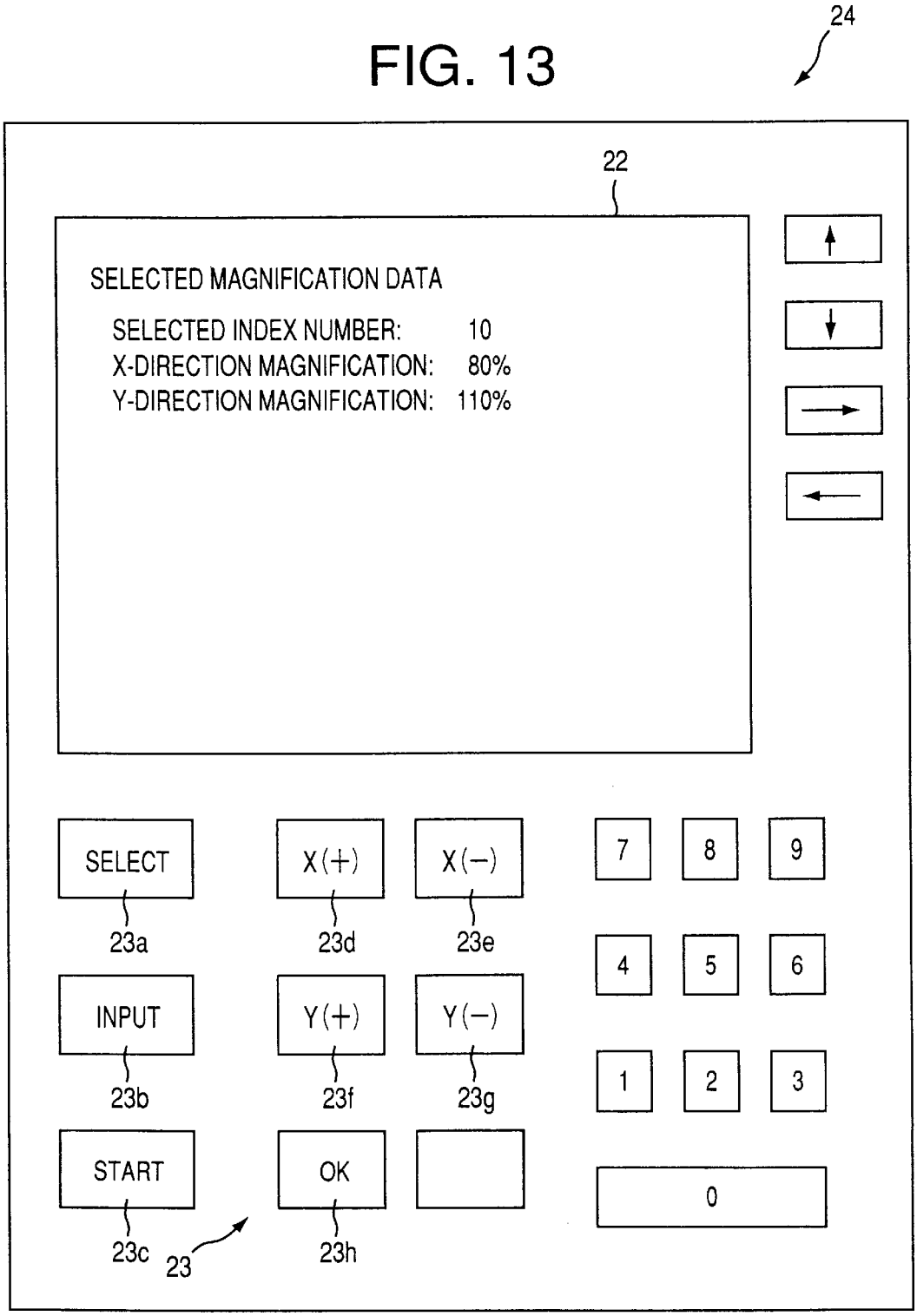
FIG. 13 is a view for explaining a selected-magnification-data image which has been selected on the display.

Next, at Step S31, the operator selects a desired index number by moving the cursor K to the desired index number by operating the cursor-moving keys labelled with arrows, and then operating the OK key 23*h*. For example, if the operator desires to select the index number "10", he or she moves the cursor K to that number and operates the OK key 23*h*, as shown in FIG. 12. Then, at Step S32, the control device 60 operates the LCD 22 to display, as the magnification data for the current pattern-sewing operation, the set of magnification data identified by the selected index number. For example, in the case where the index number "10" is selected by the operator, the LCD 22 displays the selected index number "10" and its corresponding X-direction magnification "80%" and Y-direction magnification "110%", as shown in FIG. 13. Then, the control returns to Step S18 of the main routine of FIG. 8.

Figure 14B:
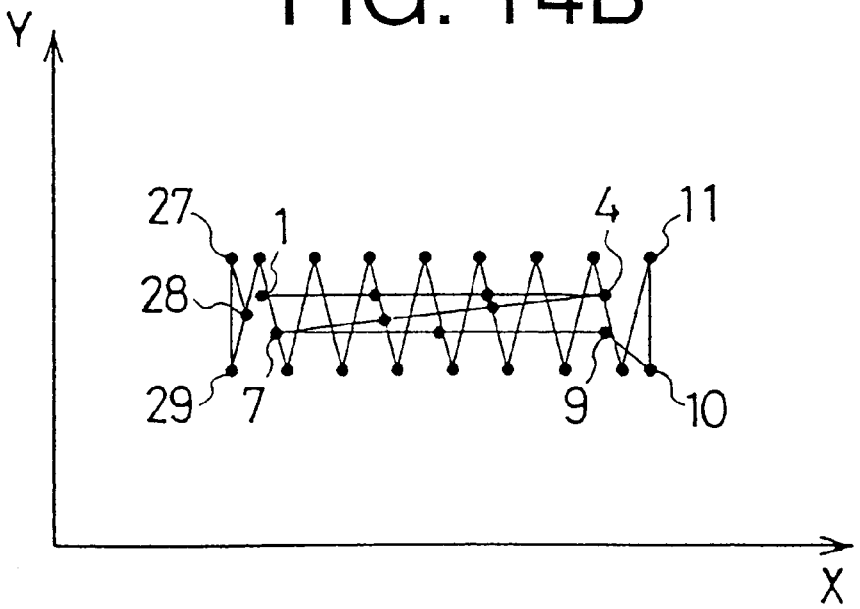
FIG. 14B is a view showing a modified set of sewing data corresponding to the enlarged bar-tacking patterns of FIG. 14A.

At Step S18, the control device 60 modifies, based on the X-direction and Y-direction magnification values identified by the selected index number, the respective sets of stitch-position data included in the set of sewing data stored in the workpiece memory of the RAM 63, so that the corresponding sewing pattern may be enlarged and/or reduced in the X-direction and/or Y-directions. The thus modified set of sewing data is stored in the workpiece memory of the RAM 63. A sewing pattern or its corresponding set of sewing data is defined in a predetermined pattern area, e.g., a rectangular or circular pattern area. In the present embodiment, each set of stitch-position data is magnified in the X and/or Y directions with respect to the center of the pattern area in the X and/or Y directions. For example, in the case where the set of sewing data shown in FIG. 7A is modified based on the X-direction magnification "80%" and the Y-direction magnification "110%" corresponding to the selected index number "10", the modified set of sewing data as shown in FIG. 14B is obtained. Then, the control returns to Step S13 of the main routine.

When the operator operates the sewing-start key 23*c*, a positive judgment is made at Step S13, a negative judgment is made at each of Steps S14 and S15, and a positive judgment is made at Step S16. Accordingly, the control goes to Step S20 in which the control device 60 operates the sewing machine to sew a modified sewing pattern corresponding to the modified set of sewing data stored in the workpiece memory of the RAM 63.

More specifically described, the control device 60 synchronizes, based on the clock pulse signals supplied from the first and second rotary encoders 66, 67, the shuttle drive motor 14 with the main shaft, and controls the θ-axis and R-axis drive motors 41, 43 of the workpiece feeding device 30, so that respective identical bar-tacking patterns are simultaneously formed on the opposite end portions of the belt loop 53*a*.

If any keys other than the keys 23*a*, 23*b*, 23*c* have been operated, a positive judgment is made at Step S13, and a negative judgment is made at each of Steps S14, S15, and S16. Accordingly, the control goes to Step S21 in which the control device 60 performs an operation or operations corresponding to the operated key or keys.

Figure 8:
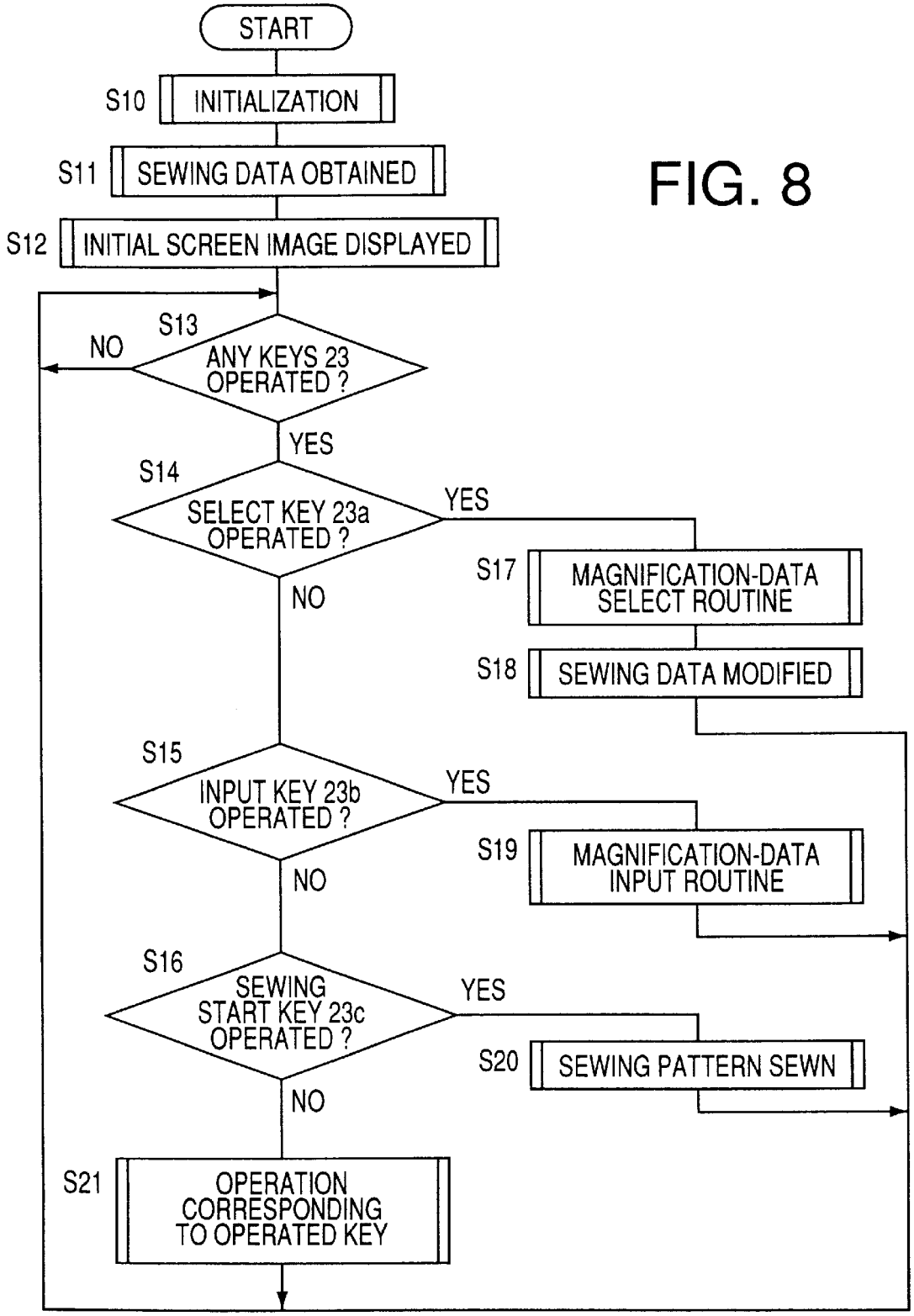
FIG. 8 is a flow chart representing a pattern-sewing control routine according to which the sewing system of FIG. 1 is operated.
Figure 9:
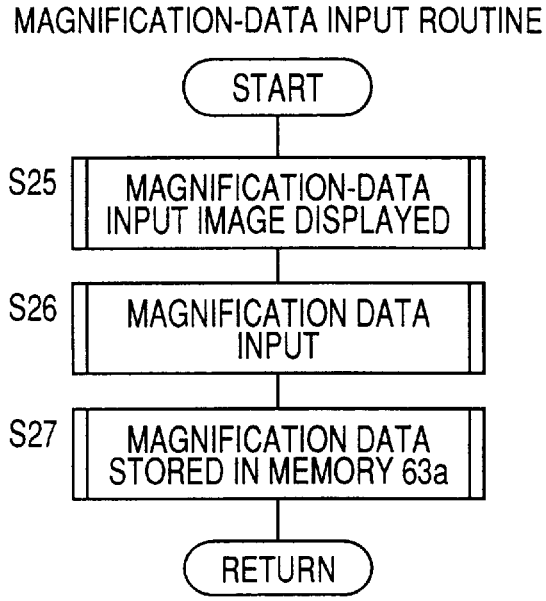
FIG. 9 is a flow chart representing a magnification-data input subroutine as one step of the main routine of FIG. 8.

As is apparent from the foregoing description, the magnification-data input key 23*b*, the LCD 22, and a portion of the control device 60 for carrying out the magnification-data input routine of FIG. 9 cooperate with one another to provide a magnification-data input device; the magnification-data select key 23*a*, the LCD 22, and a portion of the control device 60 for carrying out the magnification-data select routine of FIG. 10 cooperate with one another to provide a magnification-data selecting device; and a portion of the control device 60 for carrying out Step S18 of the main routine of FIG. 8 provides a sewing-data modifying means.

In the present sewing system 1, one or more sets of sewing data each set of which is used for simultaneously forming respective identical bar-tacking patterns on the opposite end portions of the belt loop 53*a* are stored in the ROM 62. According to the magnification-data input routine of FIG. 9, the control device 60 stores, in the magnification-data memory 63*a*, two or more sets of magnification data each set of which represents an index number, an X-direction magnification (%), and a Y-direction magnification (%). According to the magnification-data select routine of FIG. 10, the control device 60 selects, from the magnification-data memory 63*a*, one of the sets of magnification data which corresponds to the index number selected by the operator based on the dimensions of the sewing areas on the opposite end portions of the belt loop 53*a*. The control device 60 modifies, based on the X-direction magnification (%) and Y-direction magnification (%) associated with the selected index number, the sets of stitch-position data included in the desired set of sewing data. Based on the modified sets of stitch-position data (i.e., the modified set of sewing data), the control device 60 controls the θ-axis drive motor 41 and the R-axis drive motor 43 of the workpiece feeding device 30, so that the workpieces including the belt loop 53*a* are fed in the X and Y directions and respective bar-tacking patterns having appropriate dimensions (i.e., width and length) are simultaneously formed on the opposite end portions of the belt loop 53*a*.

According to the present invention, two or more sets of magnification data for enlarging or reducing at least one predetermined dimension of an original sewing pattern or at least one predetermined dimension of each of two or more original sewing patterns are stored in association with their index numbers in the magnification-data memory 63*a*. The index numbers stored in the memory 63*a* are displayed on the LCD 22, so that one of the index numbers is selected by the operator. Thus, the operator needs not input a desired set of magnification data each time a sewing pattern is sewn, but just selects one of the index numbers which corresponds to a desired set of magnification data stored in the memory 63*a*. This leads to improving the operability of the sewing system 1 and the efficiency of operation of the operator.

In addition, according to the magnification-data input routine of FIG. 9, a desirable X-direction magnification and a desirable Y-direction magnification can be input independent of each other. Therefore, even in the case where the ratio of length to width of each of two rectangular sewing areas on the belt loop 53*a* differs from that of the rectangular pattern area in which the set of sewing data is defined, the set of sewing data can be modified to fit the sewing area. Thus, the set of sewing data can be much more freely modified.

Moreover, according to the magnification-data select routine of FIG. 10, two or more index numbers read from the magnification-data memory 63*a* are displayed on the LCD 22, so that one of the index numbers is selected by the operator who moves the cursor K on the screen image of the LCD 22. Thus, a desired set of magnification data can be easily selected.

Furthermore, based on the X-direction and Y-direction magnification values corresponding to the selected index number, the control device 60 modifies the set of sewing data for sewing the bar-tacking pattern N, so that the modified set of sewing data is the most appropriate for the sewing areas of the particular belt loop 53*a*. This leads to improving the efficiency of forming of the sewing pattern N.

Figure 15:
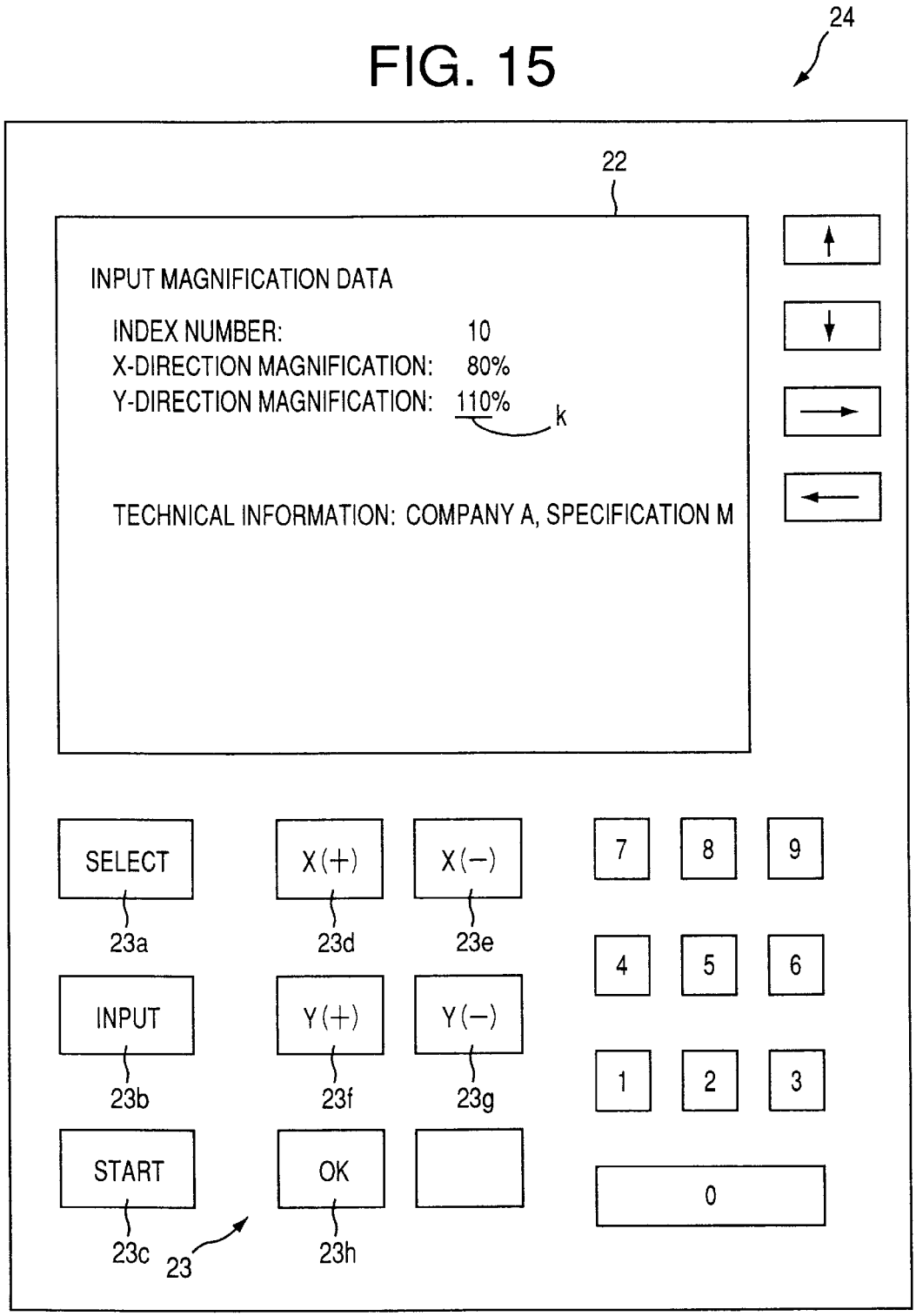
FIG. 15 is a view for explaining a magnification-data input image which is displayed on a display of another sewing system as a second embodiment of the present invention.
Figure 16:
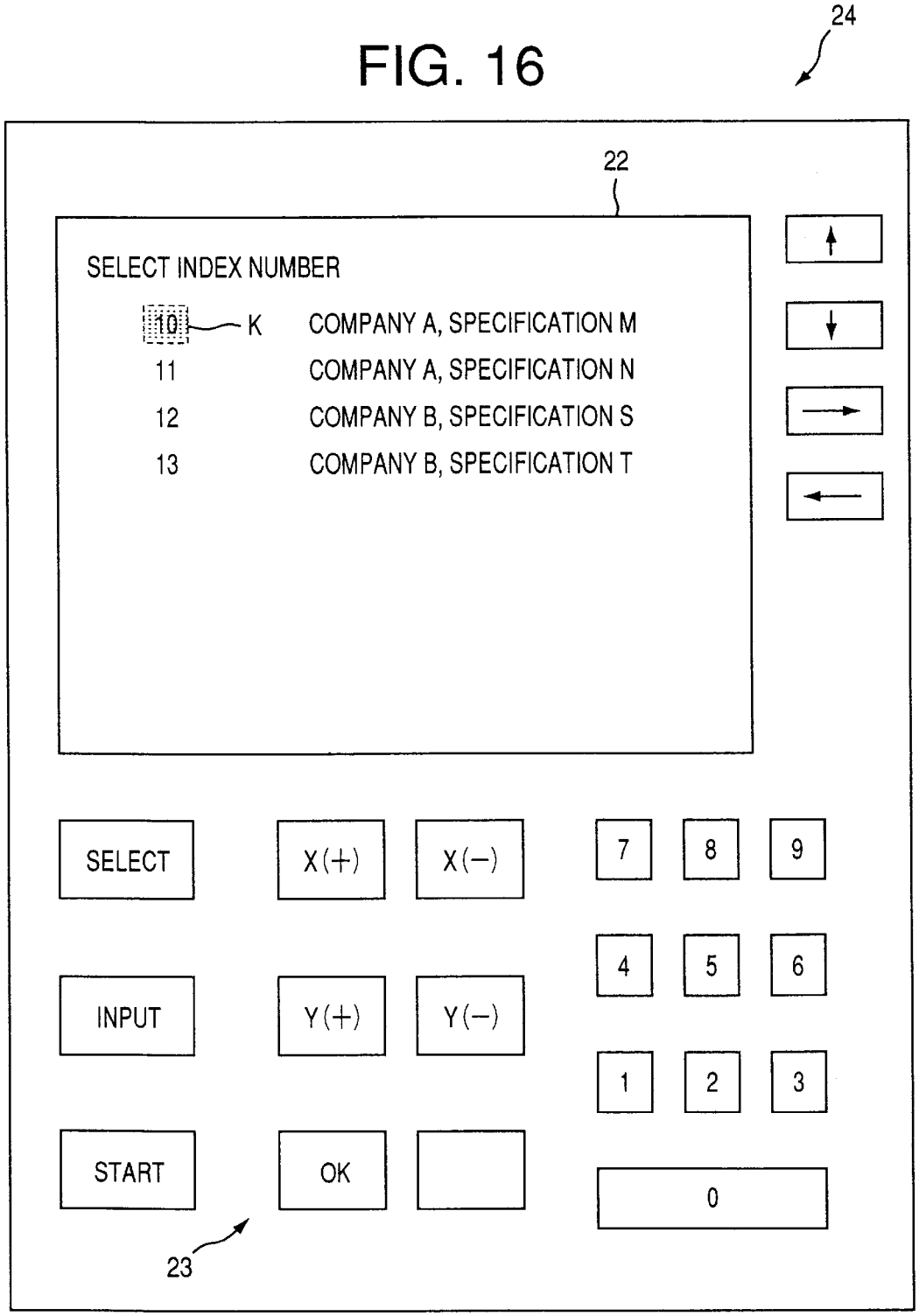
FIG. 16 is a view for explaining a magnification-data select image which is displayed on the display of FIG. 15.

FIGS. 15 and 16 show a modified embodiment of the present invention, in which an alphabetic keyboard (not shown) is connected to the operation panel 24. In this embodiment, at Step S26 of FIG. 9, the operator inputs, when inputting each set of magnification data, technical information representing a company and a specification which specifies the set of magnification data, such as "COMPANY A, SPECIFICATION M", as shown in FIG. 15. At Step S30 of FIG. 10, the control device 60 operates the LCD 22 to display, in the magnification-data select screen image, the pieces of technical information in addition to the index numbers, as shown in FIG. 16. The operator who views the screen image can select a desirable one of the stored sets of magnification data by selecting one of the index numbers in view of a corresponding one of the pieces of technical information. However, it is possible to display only the pieces of technical information, without displaying the index numbers. In the latter case, the operator selects a desirable one of the stored sets of magnification data by designating, with the cursor K, a corresponding one of the pieces of technical information on the LCD 22.

Figure 17:
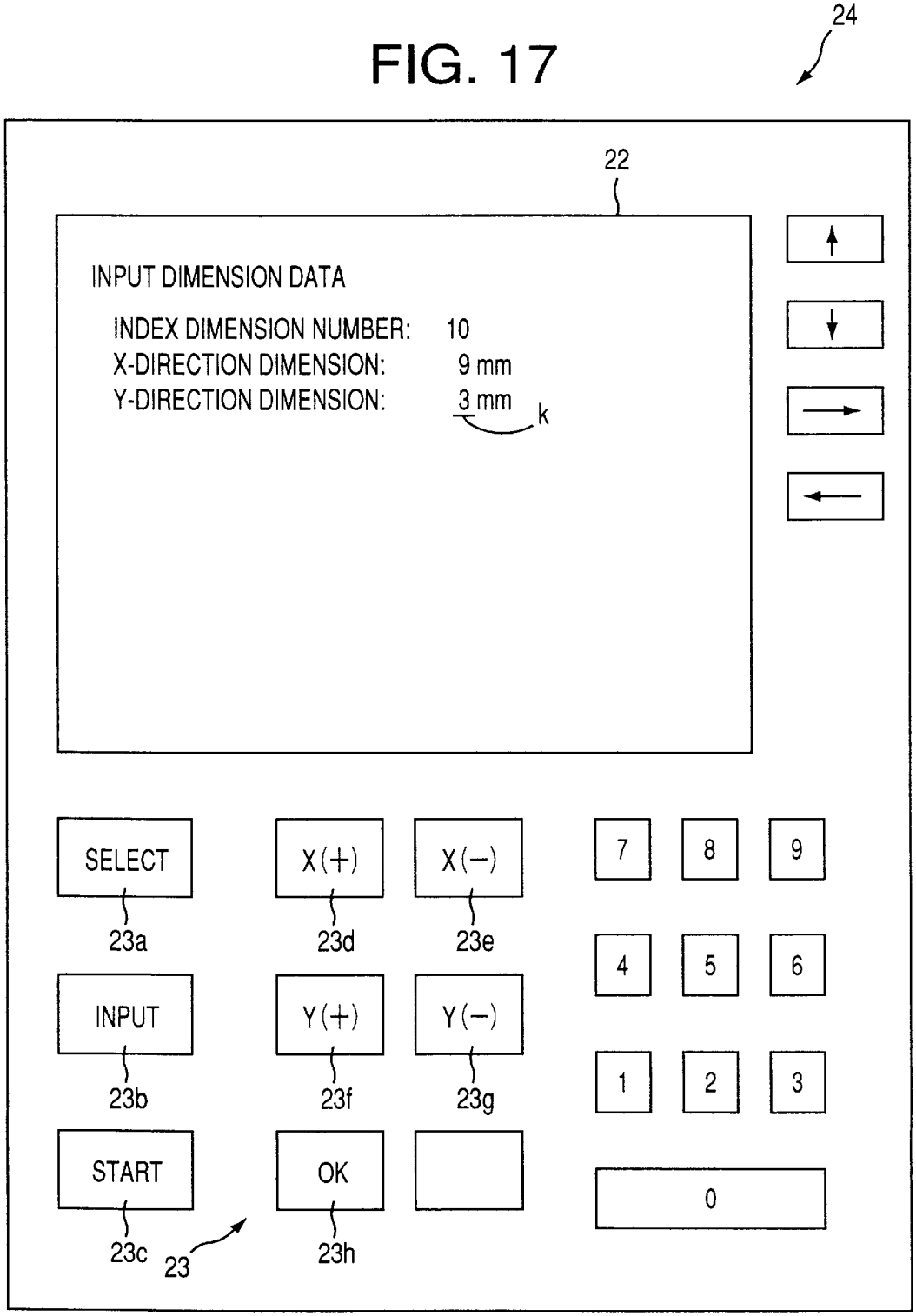
FIG. 17 is a view for explaining a dimension-data input image which is displayed on a display of another sewing system as a third embodiment of the present invention.

FIG. 17 shows another modified embodiment of the present invention. In this embodiment, at Step S26 of FIG. 9, the operator inputs and stores a plurality of sets of dimension data each set of which represents a desirable X-direction dimension (e.g., 9 mm) and a desirable Y-direction dimension (e.g., 3 mm). At Step 30 of FIG. 10, the operator can select a desirable one of the stored sets of dimension data by selecting a corresponding one of the index numbers displayed on the LCD 22. The control device 60 divides, by the respective original dimensions (e.g., 10 mm length and 3 mm width) of the original sewing pattern, the X-direction and Y-direction dimensions (e.g., 9 mm and 3 mm) associated with the selected index number (e.g., 10), respectively, and modifies the selected set of sewing data based on the thus obtained X-direction and Y-direction magnification values (e.g., 90% and 100%).

Figure 18:
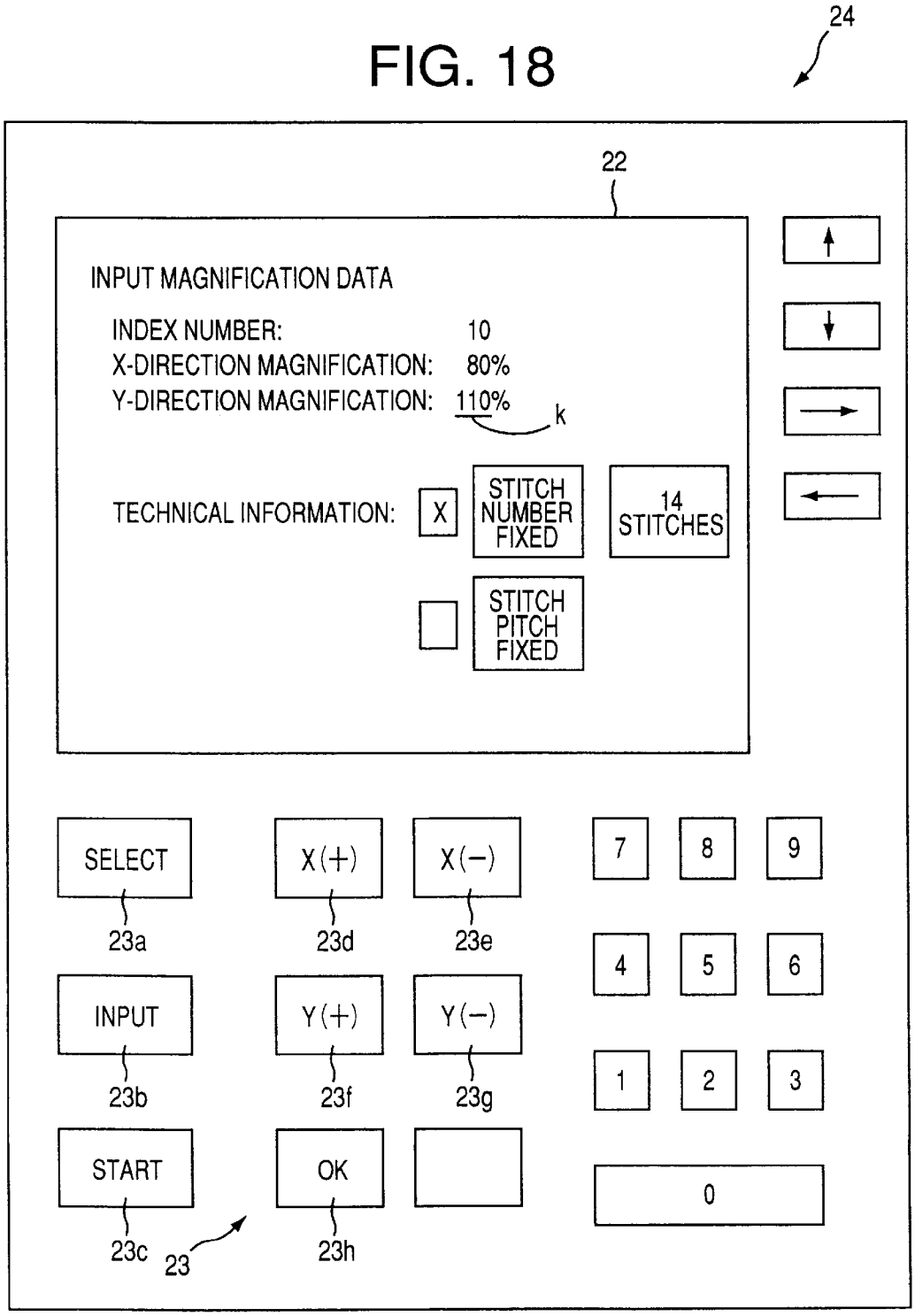
FIG. 18 is a view for explaining a magnification-data input image which is displayed on a display of another sewing system as a fourth embodiment of the present invention.
Figure 19:
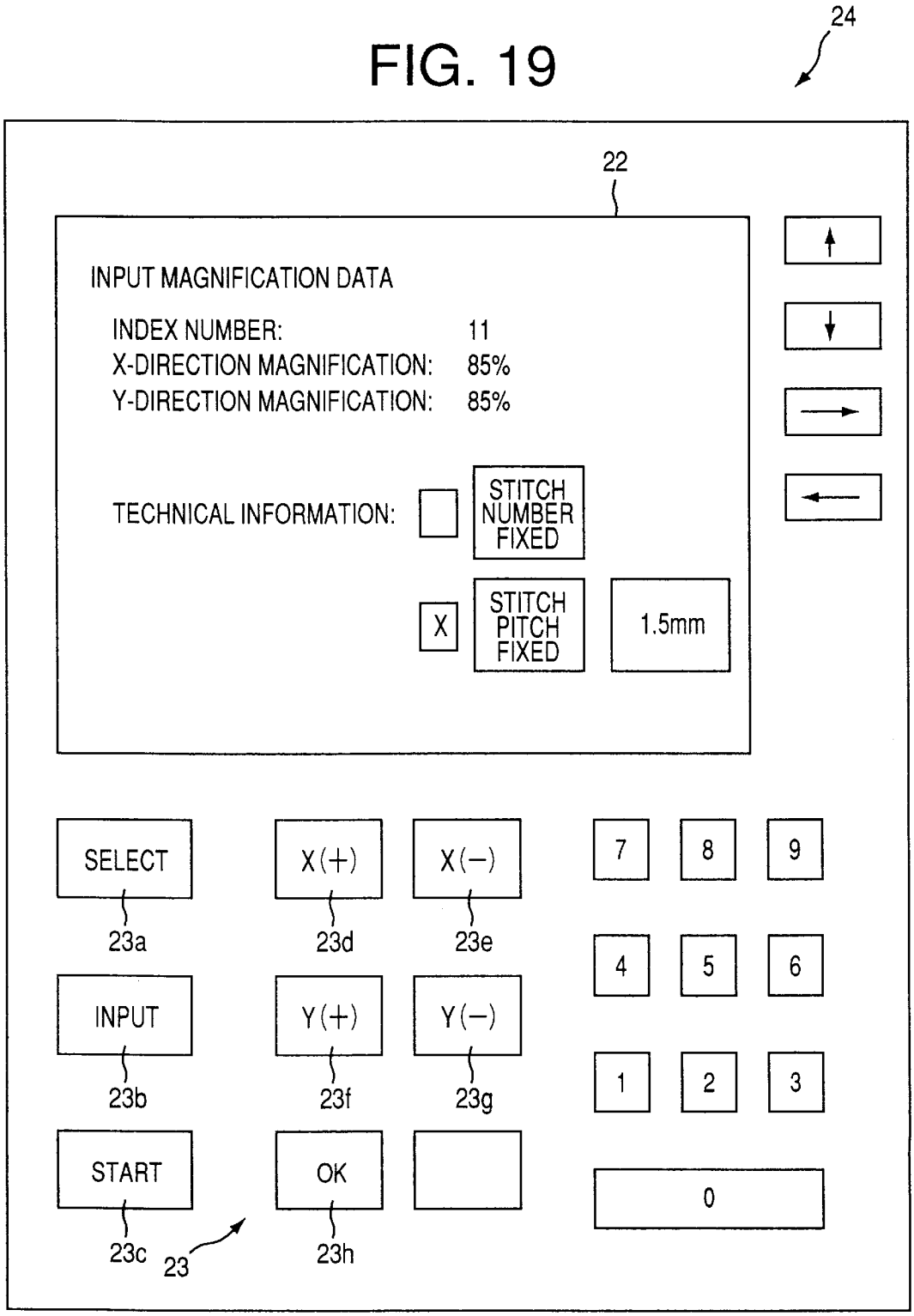
FIG. 19 is a view for explaining the manner in which stitch pitch is fixed and stitch number is changed on the magnification-data input image of FIG. 18.
Figure 20:
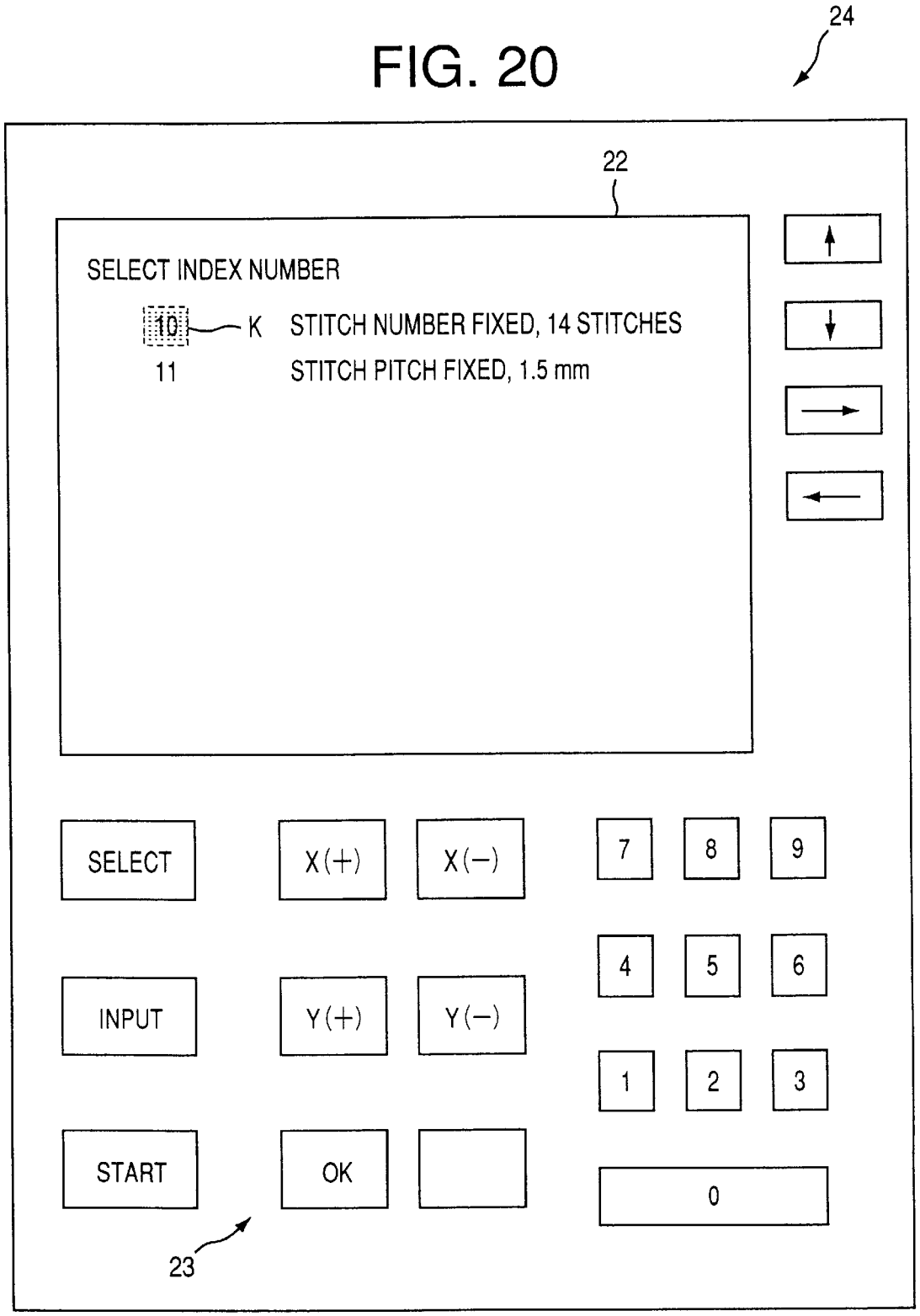
FIG. 20 is a view for explaining a magnification-data select image which is displayed on the display of FIG. 18.

FIGS. 18, 19, and 20 show another modified embodiment of the present invention. In this embodiment, at Step S26 of FIG. 9, the operator inputs, when inputting each set of magnification data, a technical information representing a stitch number or a stitch pitch relating to the set of magnification data, such as "STITCH NUMBER FIXED, 14 STITCHES", or "STITCH PITCH FIXED, 1.5 mm", as shown in FIG. 18 or FIG. 19. The operator may select a pattern number corresponding to a zigzag pattern. Stitch number is defined as the total number of stitches of a sewing pattern such as the zigzag pattern. The original stitch number of the zigzag pattern is 14. Stitch pitch is defined as the distance of interval at which stitches of a sewing pattern are formed in a particular direction. The original stitch pitch of the zigzag pattern is 1.5 mm. At Step S30 of FIG. 10, the control device 60 operates the LCD 22 to display, in the magnification-data select screen image, the pieces of technical information in addition to the index numbers, as shown in FIG. 20. The operator who views the screen image can select a desirable one of the stored sets of magnification data, by selecting one of the index numbers in view of a corresponding one of the pieces of technical information.

While the present invention has been described in its preferred embodiments, it is to be understood that the present invention may otherwise be embodied.

For example, at Step S30 of FIG. 10, the control device 60 may operate the LCD 22 to display, in the magnification-data select screen image, the combinations of X-direction and Y-direction magnification values (or dimensions) in addition to the index numbers. In this case, the operator who views the screen image can select a desirable one of the stored sets of magnification (or dimension) data by selecting one of the index numbers in view of a corresponding one of the combinations of X-direction and Y-direction magnification values (or dimensions). Otherwise, it is possible to display only the combinations of X-direction and Y-direction magnification values (or dimensions), without displaying the index numbers.

While in the illustrated embodiments the sewing system 1 stores a plurality of sets of magnification (or dimension) data each set of which includes an index number and a combination of X-direction and Y-direction magnification values (or dimensions). However, the sewing system 1 may store a plurality of sets of X-direction magnification (or dimension) data each set of which includes an X-direction index number and an X-direction magnification value (or dimension), and a plurality of sets of Y-direction magnification (or dimension) data each set of which includes a Y-direction index number and a Y-direction magnification value (or dimension). In this case, the operator who views the data select screen image displayed on the LCD 22 selects one of the X-direction index numbers and one of the Y-direction index numbers, so that a sewing pattern is sewn according to a set of sewing data modified based on the X-direction magnification value (or dimension) corresponding to the selected X-direction index number and the Y-direction magnification value (or dimension) corresponding to the selected Y-direction index number. Alternatively, the sewing system 1 may store a plurality of sets of magnification (or dimension) data each set of which represents an index number and an X-and-Y-direction magnification. The X-and-Y-direction magnification is commonly used to magnify a sewing pattern in both the X and Y directions. Thus, all magnified sewing patterns are similar to the original sewing pattern.

The principle of the present invention may be applied to an electronically controlled sewing machine which forms, using a single sewing needle, a "holing" sewing pattern or a "zigzag" sewing pattern, or other electronically controlled sewing apparatuses or systems, such as a sewing system which is controlled by a personal computer.

It is to be understood that the present invention may be embodied with other changes, improvements, and modifications that may occur to the person skilled in the art without departing from the scope and spirit of the invention defined in the appended claims.

What is claimed is:

1. A sewing system comprising:

a stitch-forming device including at least one sewing needle, for forming stitches on at least one workpiece;

a feeding device which feeds at least one of the stitch-forming device and the workpiece relative to the other of the stitch-forming device and the workpiece along a reference plane;

a control device which controls, according to at least one set of sewing data corresponding to at least one sewing pattern including a plurality of stitches, the stitch-forming device and the feeding device to form the stitches of the sewing pattern on the workpiece;

a dimension-data memory which stores a plurality of sets of dimension data which correspond to a plurality of dimensions, respectively, each of which relates to the set of sewing data; and a selecting device which is operable for selecting one of the sets of dimension data stored in the dimension-data memory.

2. The sewing system according to claim 1, wherein the feeding device comprises a workpiece feeding device which feeds said at least one workpiece comprising a belt loop having predetermined dimensions, and a base material, relative to the stitch-forming device so that the belt loop is sewn to the base material with the stitches of the sewing pattern formed by the stitch-forming device.

3. The sewing system according to claim 2, wherein the stitch-forming device comprises two sewing needles for simultaneously forming respective identical sewing patterns on opposite end portions of the belt loop.

4. The sewing system according to claim 2, further comprising a belt-loop supplying device which supplies the belt loop to the workpiece feeding device.

5. The sewing system according to claim 1, wherein the control device comprises:

modifying means for modifying the set of sewing data based on the set of dimension data selected through the selecting device; and control means for controlling, according to the modified set of sewing data, the stitch-forming device and the feeding device to form, on the workpiece, a sewing pattern having a dimension corresponding to the selected set of dimension data.

6. The sewing system according to claim 5, wherein the set of sewing data comprises a plurality of sets of stitch-position data each set of which represents a stitch position where the sewing needle penetrates the workpiece to form a corresponding one of the stitches of the sewing pattern, and wherein the modifying means comprises means for modifying the sets of stitch-position data based on the selected set of dimension data, and the control means controls, according to the modified sets of stitch-position data, the stitch-forming device and the feeding device to form the stitches of the sewing pattern having the dimension corresponding to the selected set of dimension data.

7. The sewing system according to claim 1, further comprising a sewing-data memory which stores said at least one set of sewing data.

8. The sewing system according to claim 1, further comprising an input device which is operable for inputting each of the sets of dimension data so that the dimension-data memory stores said each set of dimension data.

9. The sewing system according to claim 1, wherein the reference plane comprises an X-Y coordinate plane defined by an X axis and a Y axis perpendicular to the X axis, and wherein the dimension-data memory comprises means for storing the sets of dimension data each set of which corresponds to a first dimension along the X axis and a second dimension along the Y axis.

10. The sewing system according to claim 9, further comprising an input device which is operable for inputting said each set of dimension data so that the dimension-data memory stores said each set of dimension data.

11. The sewing system according to claim 9, wherein the stitch-forming device comprises a first drive device for reciprocating the sewing needle, and the feeding device comprises a second drive device for feeding said at least one of the stitch-forming device and the workpiece substantially along the X axis and a third drive device for feeding said at least one of the stitch-forming device and the workpiece substantially along the Y axis, substantially independent of the movement of said at least one of the stitch-forming device and the workpiece along the X axis.

12. The sewing system according to claim 1, wherein the selecting device comprises:

a display device which displays at least one of (a) the sets of dimension data stored in the dimension-data memory and (b) a plurality of sets of identification data each set of which identifies a corresponding one of the sets of dimension data; and a designator which is operable for designating, on the display device, at least one of (a) one of the sets of dimension data and (b) one of the sets of identification data.

13. The sewing system according to claim 12, wherein the dimension-data memory comprises memory means for storing the sets of dimension data and the sets of identification data.

14. The sewing system according to claim 13, wherein the memory means comprises means for storing the sets of identification data each set of which represents an index number identifying a corresponding one of the sets of dimension data.

15. The sewing system according to claim 13, wherein the memory means comprises means for storing the sets of identification data each set of which identifies a company and a specification specifying a corresponding one of the sets of dimension data.

16. The sewing system according to claim 1, wherein the dimension-data memory comprises memory means for storing the sets of dimension data comprising a plurality of sets of magnification data which represents a plurality of magnifications, respectively, each of which relates to the at least one set of sewing data.

17. The sewing system according to claim 16, wherein the reference plane comprises an X-Y coordinate plane defined by an X axis and a Y axis perpendicular to the X axis, and wherein the memory means comprises means for storing the sets of magnification data each set of which represents a first magnification with respect to the X axis, and a second magnification with respect to the Y axis.

18. The sewing system according to claim 1, wherein the dimension-data memory comprises a non-volatile memory.

19. A sewing system comprising:

a stitch-forming device including at least one sewing needle, for forming respective identical sewing patterns each of which includes a plurality of stitches, on opposite end portions of a belt loop having predetermined dimensions;

a feeding device which feeds the belt loop and a base material relative to the stitch-forming device along a reference plane;

a sewing-data memory which stores a set of sewing data corresponding to the identical sewing patterns;

a control device which controls, according to the set of sewing data, the stitch-forming device and the feeding device to form the stitches of the identical sewing patterns on the belt loop; and an input device which is operable for inputting a set of dimension data which corresponds to at least one dimension relating to the set of sewing data, wherein the control device comprises modifying means for modifying, based on the input set of dimension data, the set of sewing data stored in the sewing-data memory, so that the control device controls, according to the modified set of sewing data, the stitch-forming device and the feeding device to form, on the belt loop, two identical sewing patterns each of which has said at least one dimension corresponding to the set of dimension data.

20. The sewing system according to claim 19, wherein the stitch-forming device comprises two sewing needles for simultaneously forming the respective identical sewing patterns on the opposite end portions of the belt loop.

21. The sewing system according to claim 19, further comprising a belt-loop supplying device which supplies the belt loop to the feeding device.

22. The sewing system according to claim 19, wherein the reference plane comprises an X-Y coordinate plane defined by an X axis and a Y axis perpendicular to the X axis, and wherein the input device comprises input means for inputting the set of dimension data which corresponds to a first dimension along the X axis and a second dimension along the Y axis.

23. The sewing system according to claim 19, wherein the input device comprises input means for inputting the set of dimension data comprising a set of magnification data which represents a magnification relating to the set of sewing data.

24. The sewing system according to claim 23, wherein the reference plane comprises an X-Y coordinate plane defined by an X axis and a Y axis perpendicular to the X axis, and wherein the input means comprises means for inputting the set of magnification data which represents a first magnification with respect to the X axis and a second magnification with respect to the Y axis.

* * * * *